US012643711B2

(12) United States Patent
Gravitt

(10) Patent No.: US 12,643,711 B2
(45) Date of Patent: Jun. 2, 2026

(54) PALLET BIN

(71) Applicant: Rehrig Pacific Company, Los Angeles, CA (US)

(72) Inventor: Derek Gravitt, Buford, GA (US)

(73) Assignee: Rehrig Pacific Company, Monterey Park, CA (US)

( * ) Notice: Subject to any disclaimer, the term of this patent is extended or adjusted under 35 U.S.C. 154(b) by 0 days.

(21) Appl. No.: 18/748,568

(22) Filed: Jun. 20, 2024

(65) Prior Publication Data

US 2024/0425234 A1 Dec. 26, 2024

Related U.S. Application Data

(60) Provisional application No. 63/522,971, filed on Jun. 23, 2023.

(51) Int. Cl.

| | |
|---|---|
| ***B65D 19/06*** | (2006.01) |
| ***B65D 6/18*** | (2006.01) |
| ***B65D 25/00*** | (2006.01) |

(52) U.S. Cl.

CPC ..... *B65D 19/06* (2013.01); *B65D 11/1833* (2013.01); *B65D 25/005* (2013.01); *B65D 2519/00273* (2013.01); *B65D 2519/00422* (2013.01)

(58) Field of Classification Search

CPC .... B65D 11/18; B65D 11/1833; B65D 25/00; B65D 25/005; B65D 25/20; B65D 2519/00273; B65D 25/00422

USPC ..... 206/600; 220/4.28, 4.29, 6–8

See application file for complete search history.

(56) References Cited

U.S. PATENT DOCUMENTS

| | | | | |
|---|---|---|---|---|
| 625,678 | A | 5/1899 | Hilzheim | |
| 1,554,161 | A | 9/1925 | Hubbard | |
| 2,200,699 | A | 5/1940 | McNulty | |
| 3,870,185 | A | 3/1975 | Sanders et al. | |
| 4,192,430 | A | 3/1980 | Cornou | |
| 4,320,845 | A * | 3/1982 | Waller | B65D 11/1846 220/6 |
| 4,674,647 | A | 6/1987 | Gyenge et al. | |
| 4,917,255 | A * | 4/1990 | Foy | B65D 11/1833 220/4.28 |
| 5,094,356 | A | 3/1992 | Miller | |
| 5,199,592 | A | 4/1993 | Reiland et al. | |
| 5,555,980 | A * | 9/1996 | Johnston | B65D 77/0466 220/4.28 |
| 6,170,689 | B1 | 1/2001 | Flesher et al. | |
| 6,601,724 | B1 | 8/2003 | Koefelda et al. | |
| 6,702,135 | B2 | 3/2004 | Pickler | |

(Continued)

FOREIGN PATENT DOCUMENTS

| | | |
|---|---|---|
| EP | 0071467 A2 | 2/1983 |
| EP | 0690003 A1 | 1/1996 |

(Continued)

*Primary Examiner* — Bryon P Gehman

(74) *Attorney, Agent, or Firm* — Carlson, Gaskey & Olds, P.C.

(57) ABSTRACT

Several embodiments disclose a pallet bin having a base and a plurality of walls pivotably secured to the base. One or more of the walls may have an access opening therein and the access opening may or may not have a door selectively covering the access opening. The walls may be designed to avoid trapping food, dirt and bacteria and to be easily washed.

36 Claims, 38 Drawing Sheets

(56) References Cited

U.S. PATENT DOCUMENTS

| | | | | |
|---|---|---|---|---|
| 7,281,637 | B2 | 10/2007 | Hadar | |
| 7,416,092 | B2 * | 8/2008 | Dubois | B65D 19/18 220/6 |
| 7,484,634 | B2 | 2/2009 | Apps | |
| 9,487,326 | B2 * | 11/2016 | Banik | B65D 19/18 |
| 9,731,864 | B2 * | 8/2017 | Turner | B65D 25/005 |
| 10,207,862 | B1 * | 2/2019 | Bailey | B65D 88/52 |
| 10,370,145 | B2 | 8/2019 | Baltz et al. | |
| 2002/0070215 | A1 | 6/2002 | Walsh et al. | |
| 2004/0200833 | A1 | 10/2004 | Dubois et al. | |
| 2011/0114528 | A1 * | 5/2011 | Hirz | B65D 21/0213 206/509 |
| 2013/0299490 | A1 * | 11/2013 | Hansen | B65D 88/522 220/7 |
| 2019/0270545 | A1 * | 9/2019 | Apps | B65D 21/086 |

FOREIGN PATENT DOCUMENTS

| | | | |
|---|---|---|---|
| GB | 1018243 | A | 1/1966 |
| GB | 1424890 | A | 2/1976 |
| GB | 2357078 | A | 6/2001 |
| GB | 2445414 | A | 7/2008 |

* cited by examiner

PALLET BIN

BACKGROUND

Pallet bins generally include a pallet base and a plurality of walls pivotable between an upright position and a collapsed position on the base. One or more of the walls may have a door mounted therein. The door may be mounted in a cutout portion through the wall, with the cutout portion opening upward through the uppermost edge of the wall. Some pallet bins are used to transport food, such as meat.

SUMMARY

A number of embodiments and options are described herein which may be practiced independently or in combinations. Some of the features disclosed herein inhibit food, dirt and bacteria being trapped in container and facilitate cleaning the container. Several optional, alternative door and access openings are described, any combination of which could be used in a pallet bin or other container. Several alternative wall structures are disclosed, which again, could be practiced in combination with one another or in combination with any of the disclosed door or access opening designs.

One embodiment discloses a pallet bine having a base and a plurality of walls extending upward from the base. The plurality of walls include a first wall, the first wall including a plurality of angled ribs therein. The plurality of angled ribs are each angled downward toward a drainage aperture, such that water within the first wall would flow along the plurality of angled ribs and through the drainage apertures.

In another disclosed embodiment, a pallet bin includes a base and a plurality of walls extending upward from the base. The plurality of walls include a first wall having an access opening, which opens through an uppermost edge of the first wall. A pair of doors may be positioned in the access opening and may be movable between an open position permitting access through the access opening and closed position over the access opening.

In another disclosed embodiment, a pallet bin includes a base and a plurality of walls extending upward from the base. The plurality of walls include a first wall having an access opening, which opens through an uppermost edge of the first wall. A door is movable between a closed position within the access opening and an open position permitting access through the access opening. The door rotates about an axis perpendicular to the first wall between the closed position and the open position.

In another disclosed embodiment, a pallet bin includes a base and a plurality of walls extending upward from the base. The plurality of walls include a first wall including a plurality of horizontal corrugations intersected by a plurality of vertical ribs.

In another disclosed embodiment, a pallet bin includes an upper base portion including an upper support surface. A plurality of ribs project downward from the upper support surface. A pair of side upstanding portions project upward from side edges of the upper support surface. A pair of end upstanding portions project upward from the end edges of the upper support surface. A lower portion includes a plurality of columns extending downward from an upper planar portion. A plurality of interlocking portions secure the upper base portion to the lower base portion. A plurality of walls include a pair of side walls pivotably connected to the side upstanding portions and a pair of end walls pivotably connected to the end upstanding portions.

DETAILED DESCRIPTION

Figure 1:
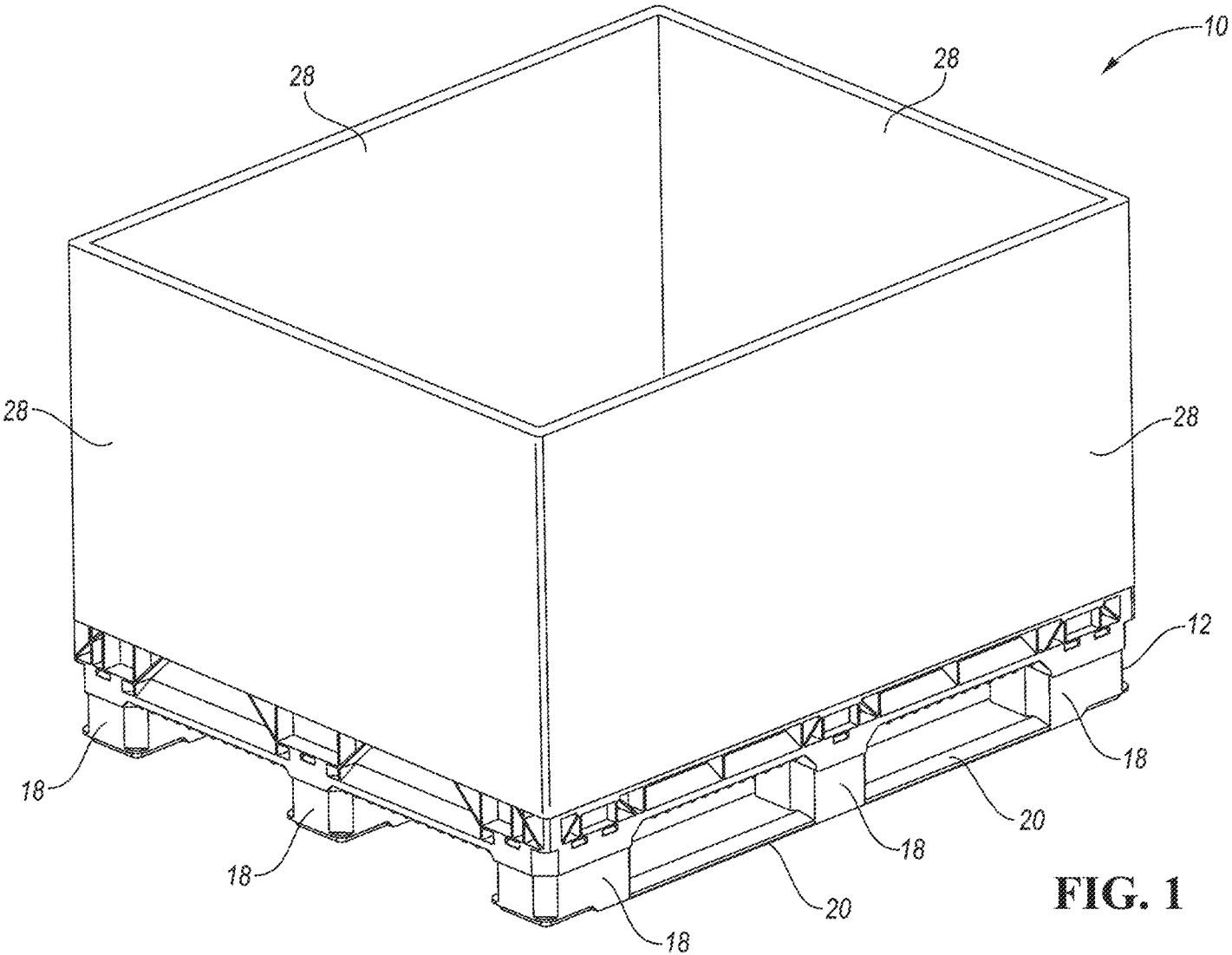
FIG. 1 shows a simplified pallet bin.

FIG. 1 is a simplified view of a collapsible container, which in this example is a pallet bin 10 including a base 12 and a plurality of walls 28 pivotably connected to the base 12. The plurality of walls 28 are movable between an upright position perpendicular to the base 12 (as shown) and a collapsed position on the base 12 (and parallel to the base 12).

A plurality of columns 18 support the base 12 above the ground, providing openings for fork tines below the base 12. Runners 20 may connect lower ends of some of the columns 18. Each of the walls 28 is a separate plastic component (and as explained below, each may be comprised one or more separately molded plastic components). The base 12 shown may be molded as several separate plastic components joined together.

Several features described herein could be incorporated into the pallet bin 10 of FIG. 1. In particular, several alternative walls and doors are described below that could be incorporated into a pallet bin similar to that in FIG. 1.

Figure 2:
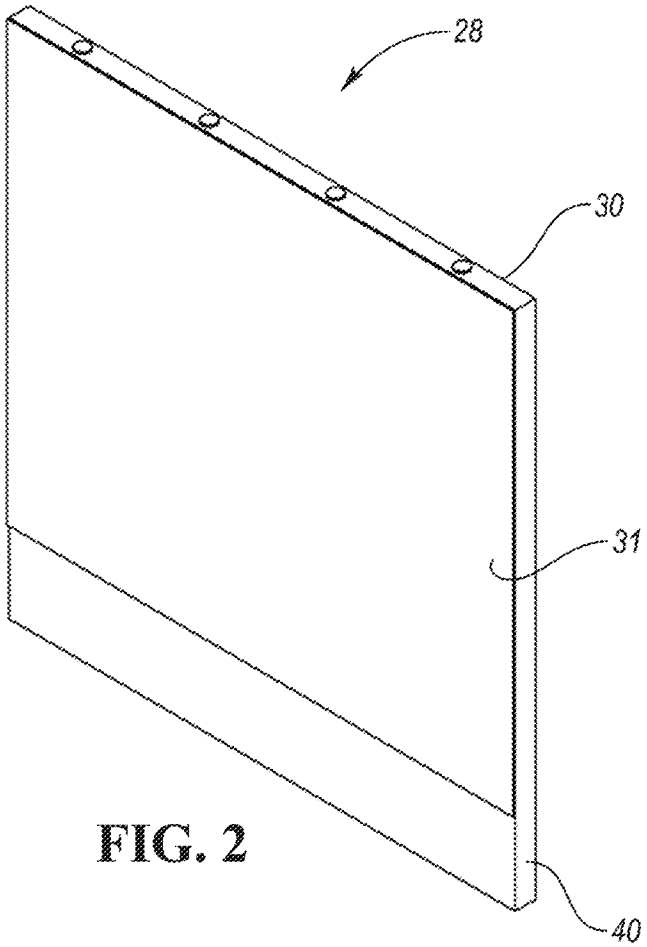
FIG. 2 illustrates a more detailed example of a wall of the pallet bin of FIG. 1.

FIG. 2 illustrates in more detail one of the walls 28 of the pallet bin 10 of FIG. 1. The wall 28 is formed as two separate main parts that are subsequently joined, i.e. a ribbed panel 30 and a sheet 31. The ribbed panel 30 has a lower portion 40.

Figure 3:
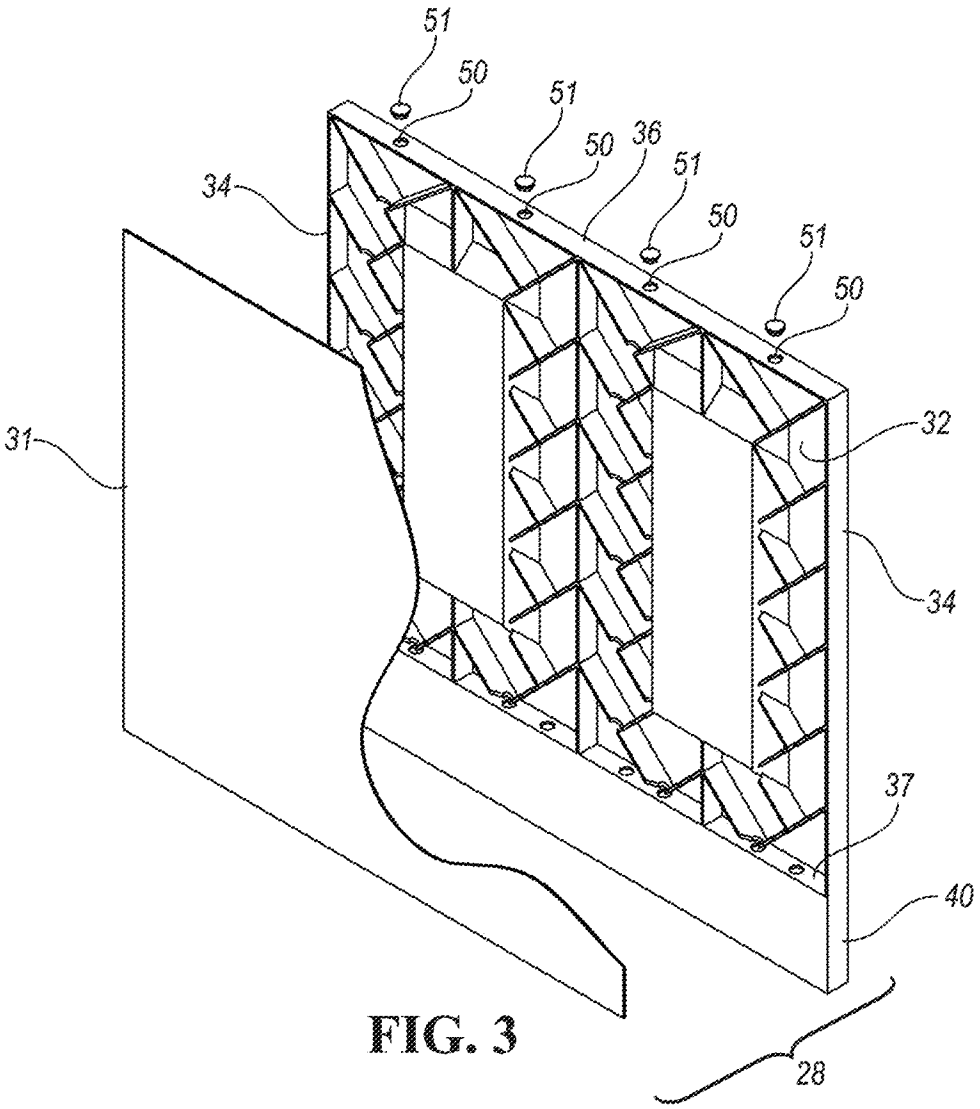
FIG. 3 is an exploded view of the wall of FIG. 2.

FIG. 3 is an exploded view of the wall 28, with the sheet 31 partially broken away. The ribbed panel 30 includes a panel portion 32 and a plurality of ribs projecting outwardly therefrom. Generally, the ribbed panel 30 is formed as a single plastic component, such as by injection molding. Alternatively, the ribbed panel 30 could be formed of more than one component that are subsequently joined. The sheet 31 may be formed as a single plastic component, such as by extrusion. The sheet 31 is then joined, such as by welding or adhesive, to the ribs of the ribbed panel 30 above the lower portion 40. The enclosure of the ribs should keep food, dirt and bacteria out of the ribs and the sheet 31 provides an easily washed surface.

Side peripheral ribs 34 project outwardly from side edges of the panel portion 32. An upper peripheral rib 36 projects outwardly from an upper edge of the panel portion 32. A lower peripheral rib 37 projects outwardly from a lower edge of the panel portion 32. The lower portion 40 of the ribbed panel 30 is defined below the lower peripheral rib 37. A plurality of lower apertures 54 are formed through the lower peripheral rib 37, leading into the lower portion 40.

As shown, the upper peripheral rib 36 includes a plurality of upper apertures 50 therethrough. A removable plug 51 selectively seals each of the plurality of upper apertures 50.

Figure 4:
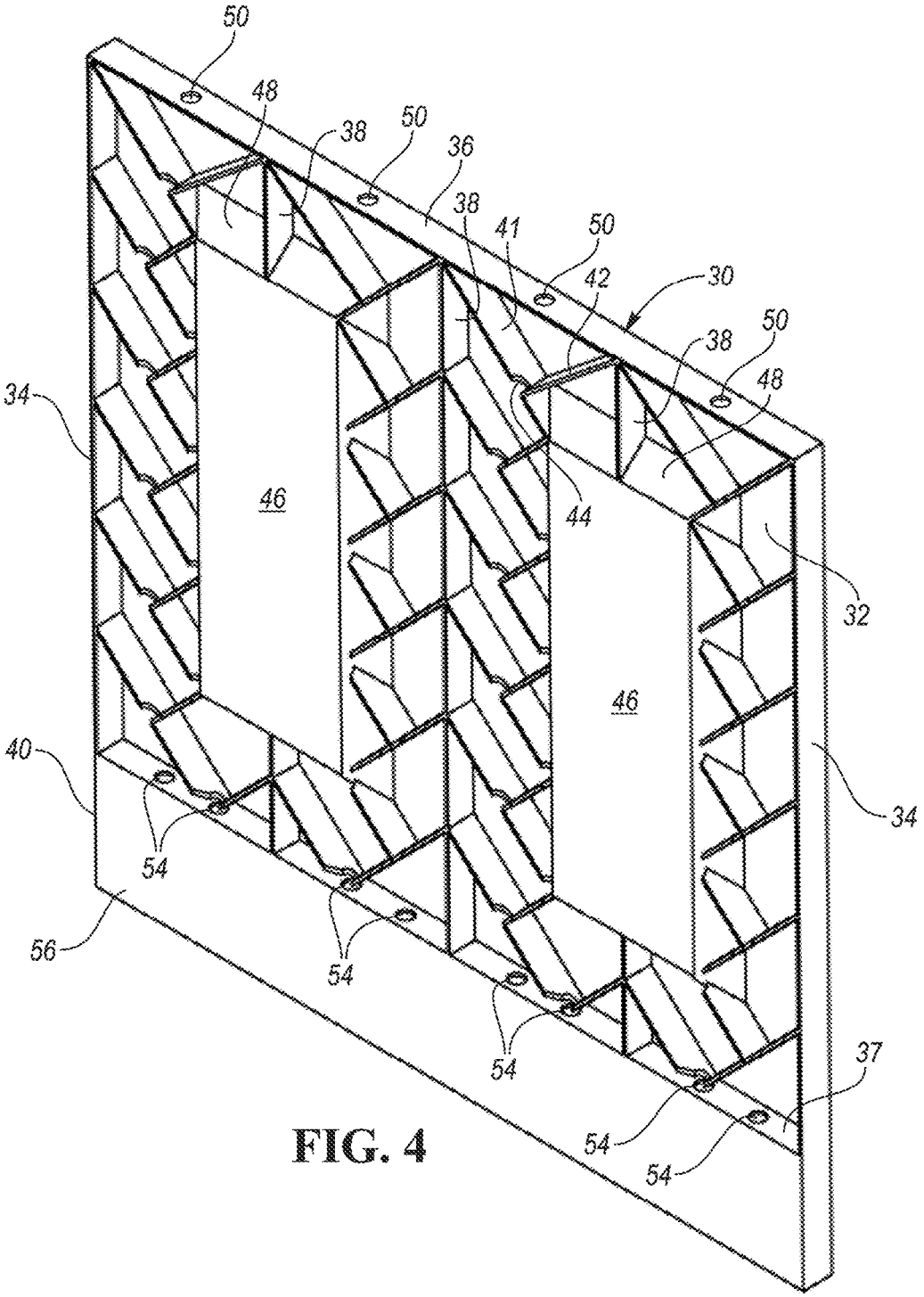
FIG. 4 shows the ribbed panel of FIG. 3.

FIG. 4 shows the ribbed panel 30. The plurality of ribs further includes a plurality of vertical ribs 38, one of which extends from the upper peripheral rib 36 to the lower peripheral rib 37 and two of which are interrupted by central panels 46. The central panels 46 are connected to the panel portion 32 by flared ribs 48 that flare outward as they extend from the central panels 46 to the panel portion 32.

Figure 5:
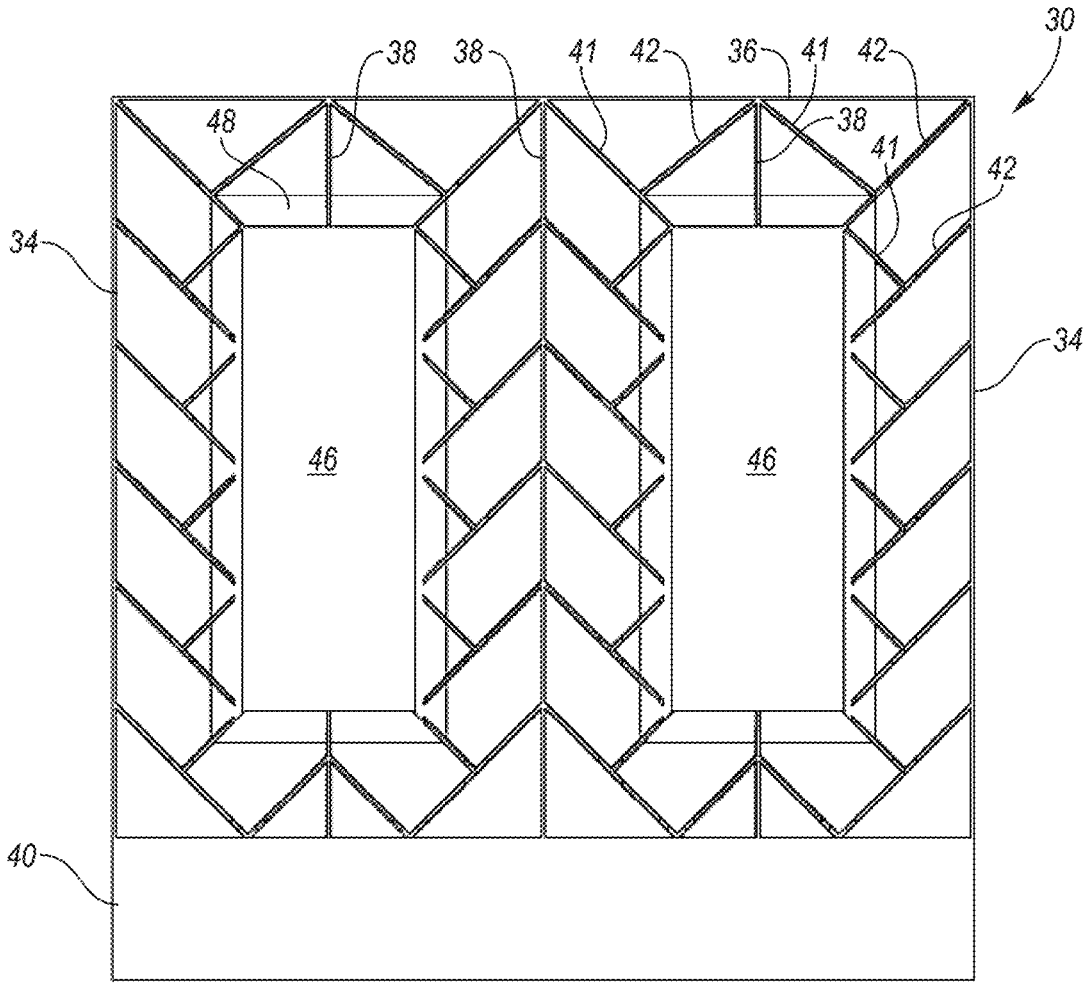
FIG. 5 is a front view of the ribbed panel of FIG. 3.

As shown more clearly in FIG. 5, the remaining area of the panel portion 32 is filled with a plurality of angled first ribs 41 extending downward at a 45-degree angle and a plurality of angled second ribs 42 extending downward at a 45-degree angle but transverse to (and preferably perpendicular to, as shown) the plurality of angled first ribs 41. The plurality of angled first ribs 41 and plurality of angled second ribs 42 connect to one another and to the plurality of vertical ribs 38.

The plurality of angled first ribs 41 each have a notch opening 44 forming a drainage opening therethrough at one end of the joint with each of the plurality of angled second ribs 42. The plurality of angled first ribs 41 and plurality of angled second ribs 42 may be perpendicular to the panel portion 32 or may be pitched slightly downward toward the openings 44.

Figure 6:
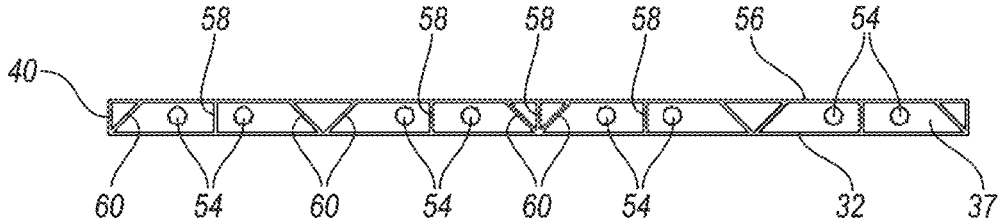
FIG. 6 is a bottom view of the ribbed panel of FIG. 3.

FIG. 6 is a bottom view of the ribbed panel 30. The lower portion 40 is defined between the panel portion 32, a front panel portion 56, and the lower peripheral rib 37. A plurality of perpendicular ribs 58 and a plurality of angled ribs 60 connect the panel portion 32 to the front panel portion 56. Thus the lower portion 40 is generally hollow, opening downwardly and reinforced by ribs.

Figure 8:
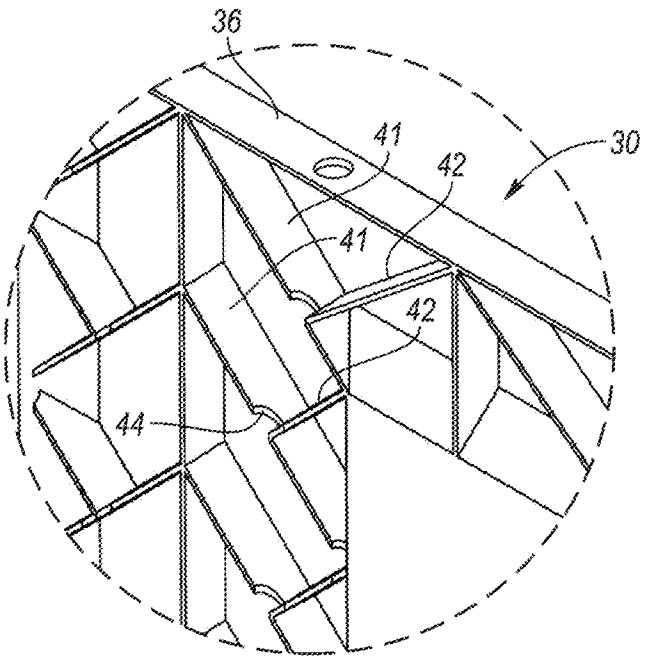
FIG. 8 is an enlarged view of a portion of the ribbed panel of FIG. 7.
Figure 7:
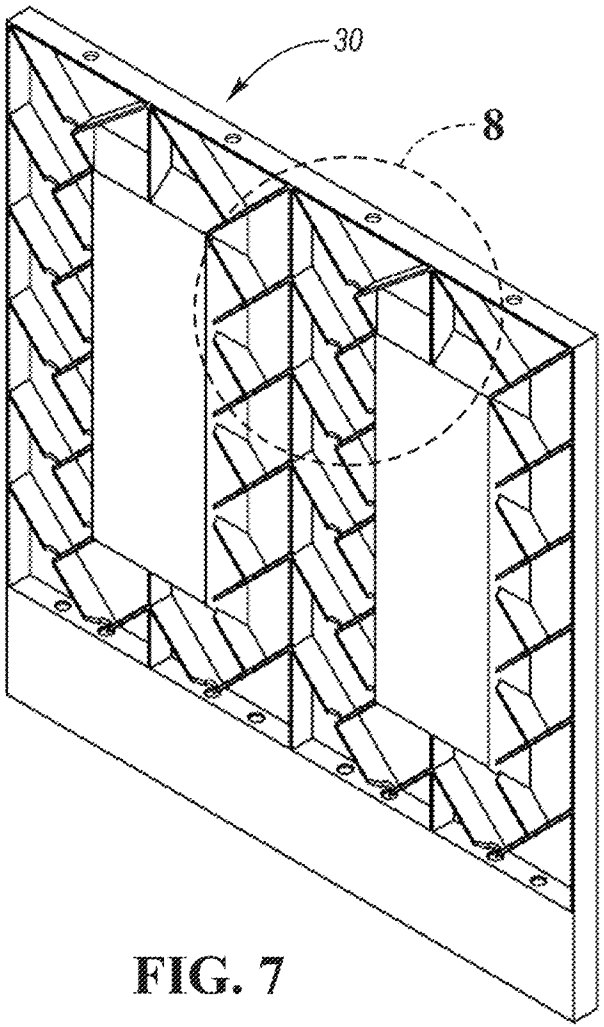
FIG. 7 is a perspective view of the ribbed panel of FIG. 3.

FIG. 7 is a perspective view of the ribbed panel 30. FIG. 8 is an enlarged view of a portion of the ribbed panel 30 of FIG. 7, showing the plurality of angled first ribs 41 and the plurality of angled second ribs 42 more clearly.

Figure 10:
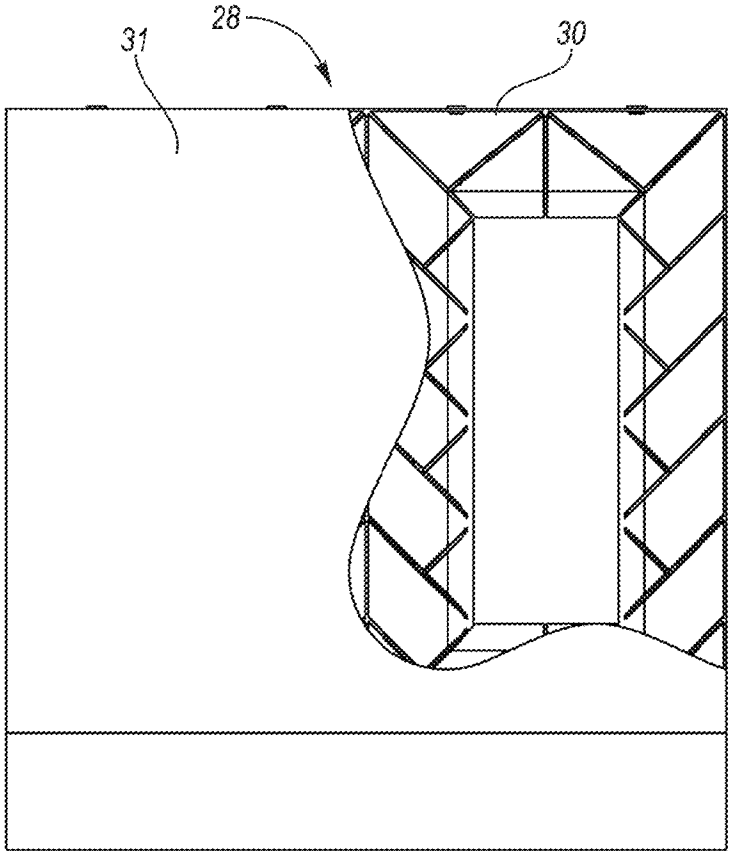
FIG. 10 is a front view of the wall of FIG. 9, with a portion of the sheet broken away to show the ribs of the ribbed panel.
Figure 9:
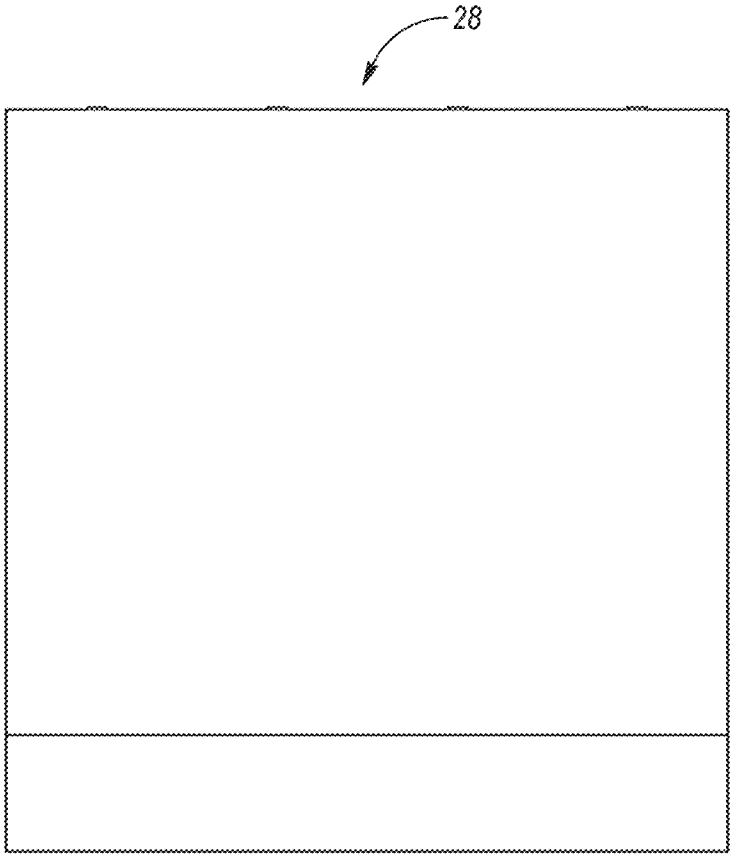
FIG. 9 is a front view of the assembled wall of FIG. 2.
Figure 11:
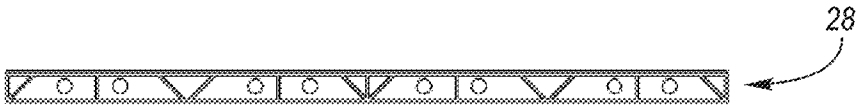
FIG. 11 is a bottom view of the wall of FIG. 10.

FIG. 9 is a front view of the assembled wall 28. FIG. 10 is a front view of the wall 28, with a portion of the sheet 31 broken away to show the ribs of the ribbed panel 30. FIG. 11 is a bottom view of the wall 28.

In use, the walls 28 could be cleaned by removing the removable plugs 51 from the tops of the walls 28. Water and/or other cleaning fluid could be introduced through the plurality of upper apertures 50. The fluid would then flow through the walls 28 along the plurality of angled first ribs 41 and plurality of angled second ribs 42, through the notch openings 44 and then through the plurality of lower apertures 54 and through the lower portion 40 and out of the walls 28. This ensures that the interior of the walls 28 is clean and lets the fluid drain out of the walls 28. The plugs 51 can then be returned to the plurality of upper apertures 50. Optionally, the walls 28 could be used without the plugs 51.

Figure 12:
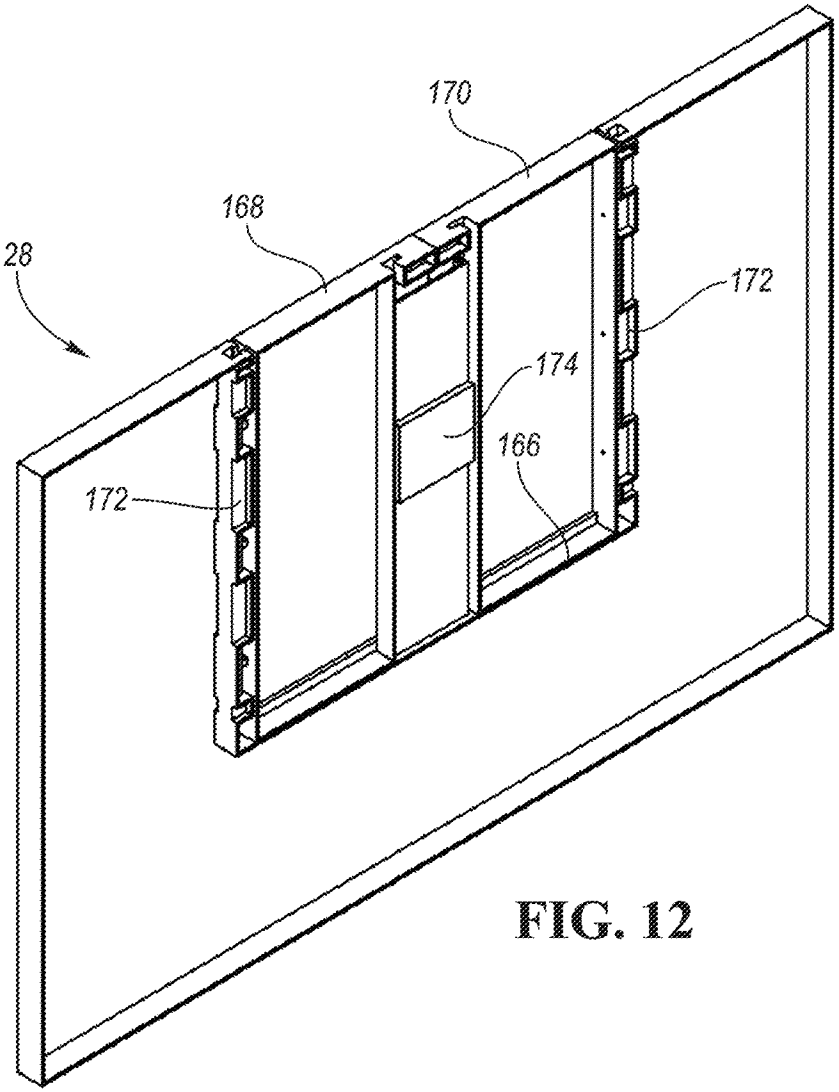
FIG. 12 is an exterior perspective view of a wall according to a second embodiment that could be used in the pallet bin of FIG. 1 or a similar pallet bin.
Figure 13:
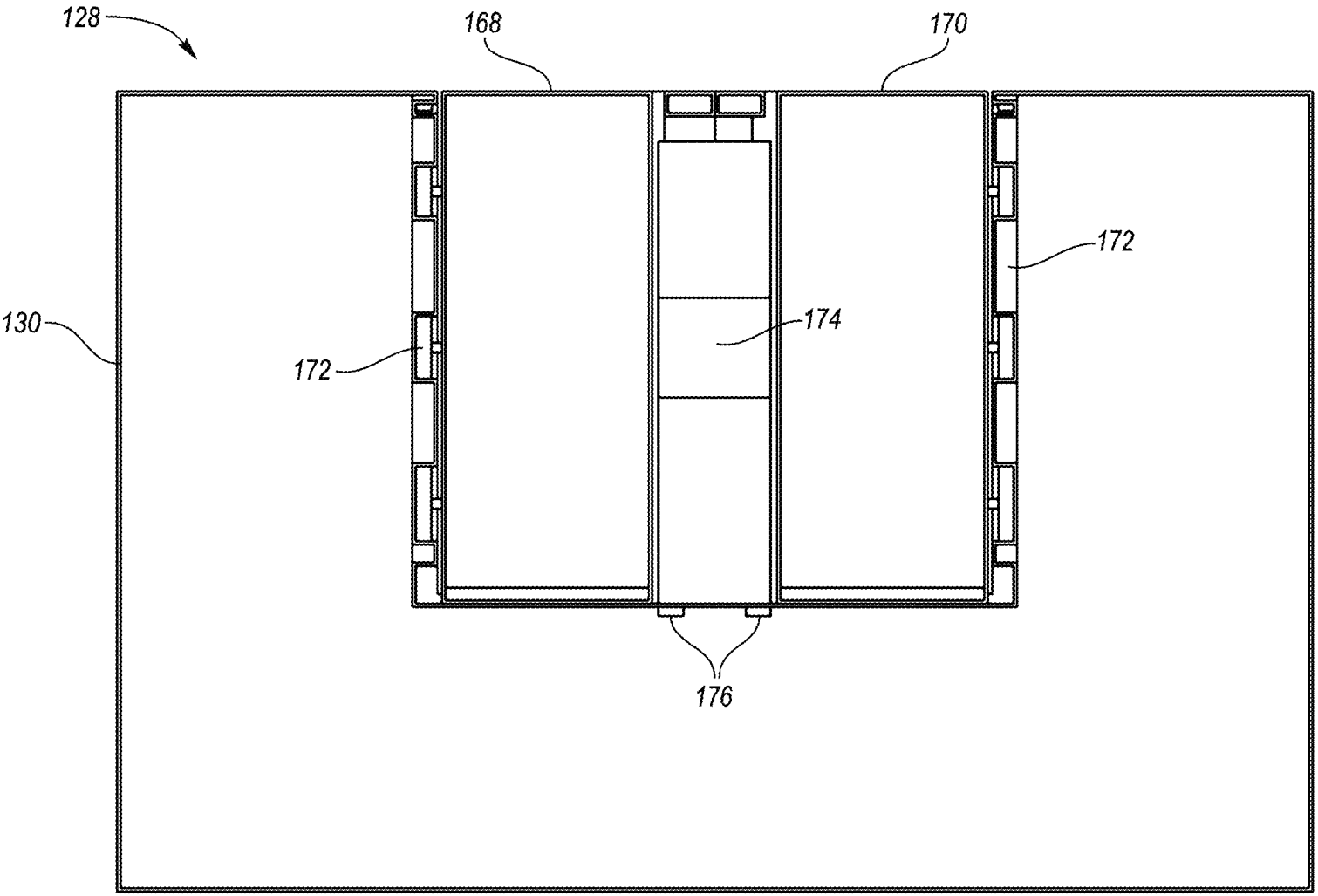
FIG. 13 is an exterior view of the wall of FIG. 12.

FIGS. 12 and 13 show a wall 128 according to a second embodiment that could be used in place of one or more of the walls 28 in the pallet bin of FIG. 1 or a similar pallet bin. The wall 128 includes a panel 130 that could have a ribbed structure similar to that of the first embodiment. The wall 128 includes an access opening 166 in which a first door 168 and a second door 170 are received. The access opening 166 opens upward through the uppermost edge of the wall 128. The access opening 166 is between approximately 40% and approximately 70% of the width of the wall 128, and more preferably approximately 50% of the width of the wall 128. The access opening 166 is between approximately 40% and approximately 70% of the height of the wall 128, and more preferably approximately 66% of the height of the wall 128.

The first door 168 and second door 170 are connected to the wall 128 by vertical hinges 172. A vertically slidable latch 174 is slidably secured to the first door 168 and selectively secures the abutting ends of the first door 168 and the second door 170. In FIGS. 12 and 13, the vertically slidable latch 174 is shown in the lower, latched position.

Referring to FIG. 13, in this example, the vertically slidable latch 174 includes a pair of projections 176 that are received in apertures in the panel 130, thereby holding the first door 168 and second door 170 in the latched position.

Figure 14:
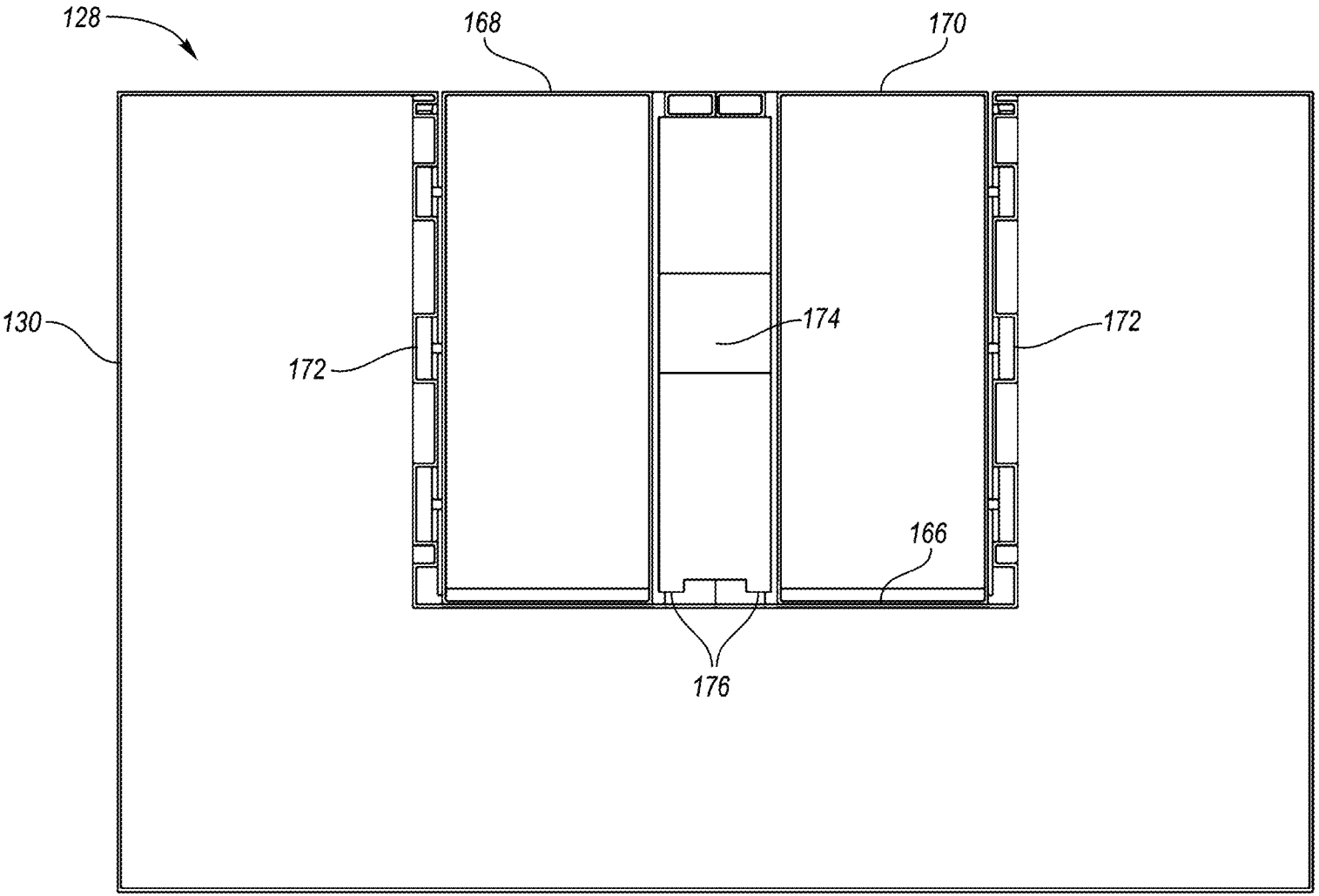
FIG. 14 shows the wall of FIG. 13 with the vertically slidable latch moved upward to the unlatched position.

In FIG. 14, the vertically slidable latch 174 has been moved upward to the unlatched position. This removes the projections 176 from the apertures in the panel 130, freeing the first door 168 and second door 170 to pivot.

Figure 15:
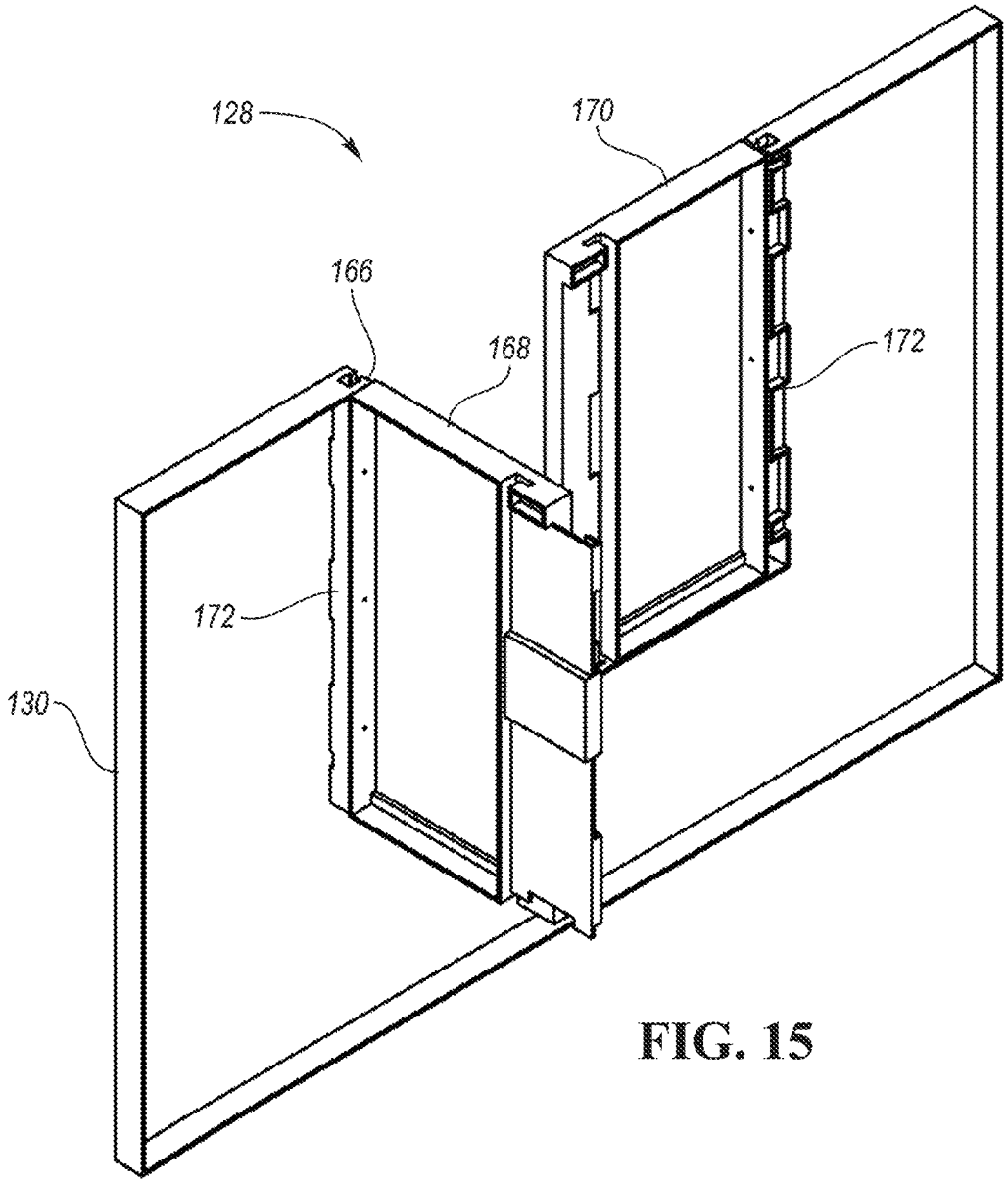
FIG. 15 shows the wall of FIG. 14 with the first door pivoted outward.

In FIG. 15, after unlatching, the first door 168 is shown pivoted outward to allow access to the interior of the pallet bin via the access opening 166. The second door 170 would also be pivoted outward.

Figure 16:
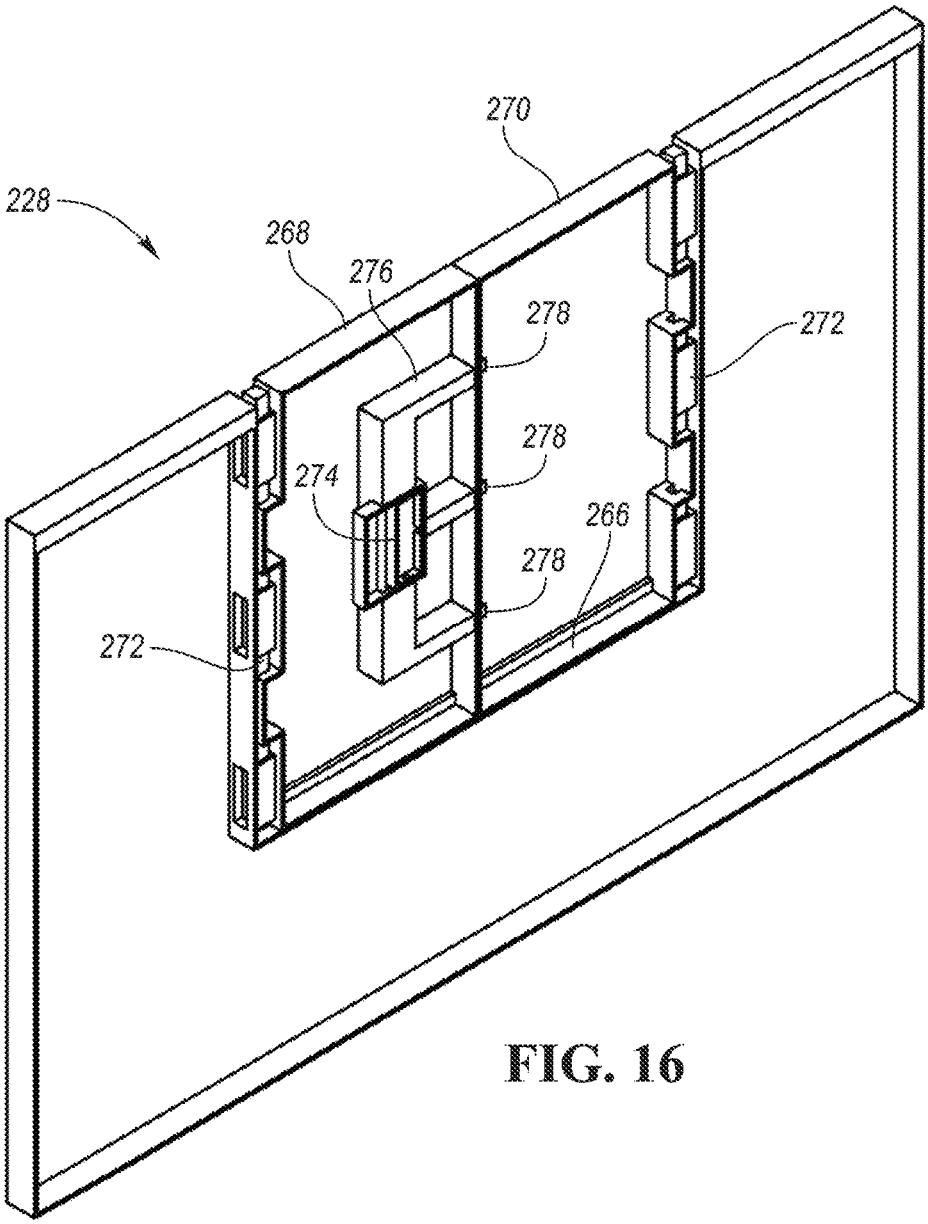
FIG. 16 is an exterior perspective view of a wall according to a third embodiment that could be used in the pallet bin of FIG. 1 or a similar pallet bin.
Figure 17:
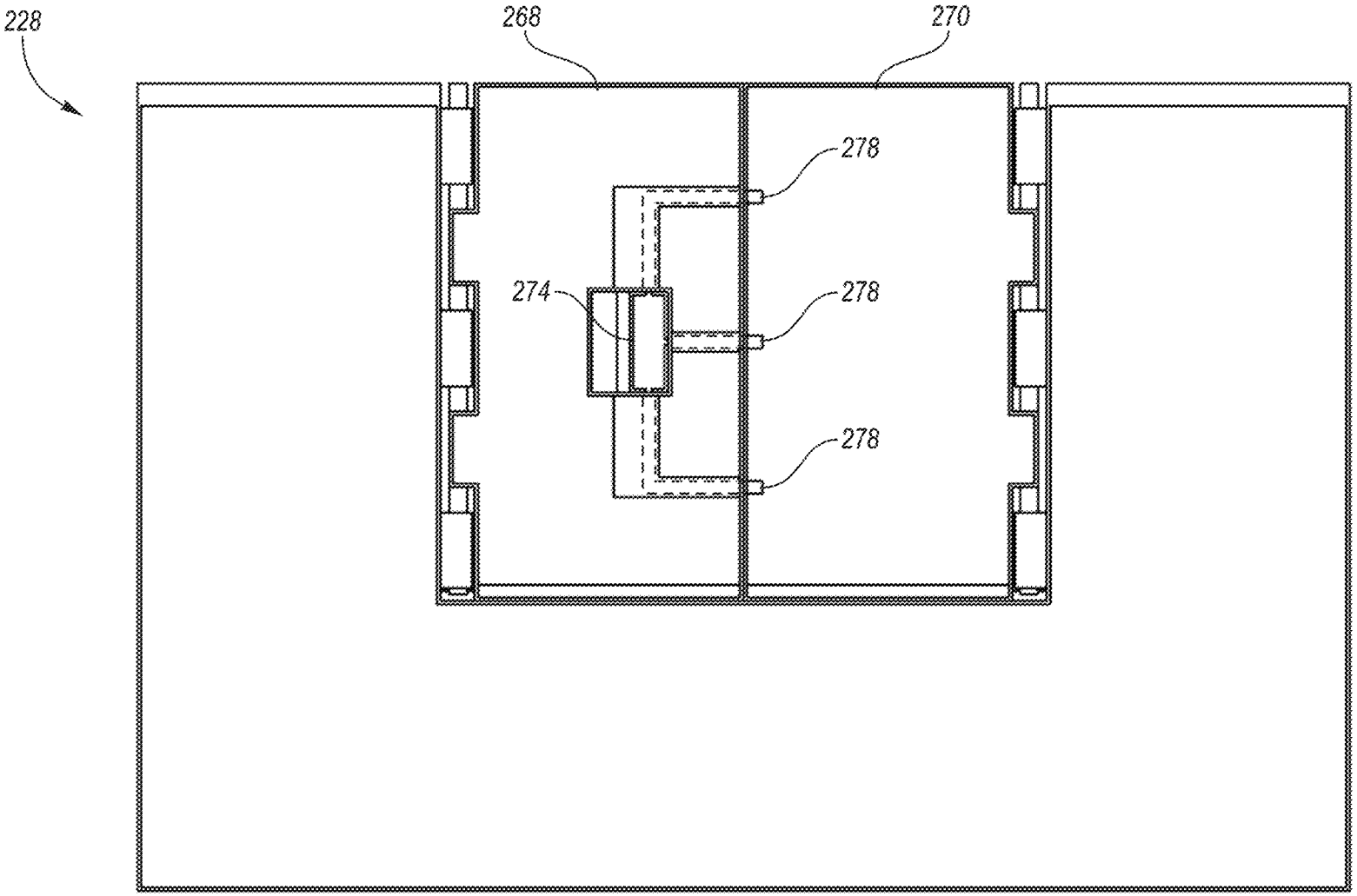
FIG. 17 is an exterior view of the wall of FIG. 16.

FIGS. 16 and 17 show a wall 228 according to a third embodiment that could be used in place of one or more of the walls of the pallet bin of FIG. 1 or a similar pallet bin. The wall 228 could have the ribbed structure similar to that of the first embodiment. The wall 228 includes an access opening 266 in which a first door 268 and a second door 270 are received. The first door 268 and second door 270 are connected to the wall 228 by vertical hinges 272. A horizontally slidable latch 274 is slidably secured to the first door 268, such as within a latch housing 276. The horizontally slidable latch 274 may be "E" shaped, so that it includes three horizontal portions leading from a vertical portion to protruding ends 278. A different number of horizontal portions and protruding ends 278 could also be used.

The access opening 266 opens upward through the uppermost edge of the wall 228. The access opening 266 is between approximately 40% and approximately 70% of the width of the wall 228, and more preferably approximately 50% of the width of the wall 228. The access opening 266 is between approximately 40% and approximately 70% of the height of the wall 228, and more preferably approximately 66% of the height of the wall 228.

The horizontally slidable latch 274 selectively secures the abutting ends of the first door 268 and the second door 270 by having a plurality of protruding ends 278 that protrude into the second door 270 when the horizontally slidable latch 274 is in the latched position as shown. In FIGS. 16 and 17, the horizontally slidable latch 274 is shown in the latched position. The plurality of protruding ends 278 protrude into the second door 270.

Figure 18:
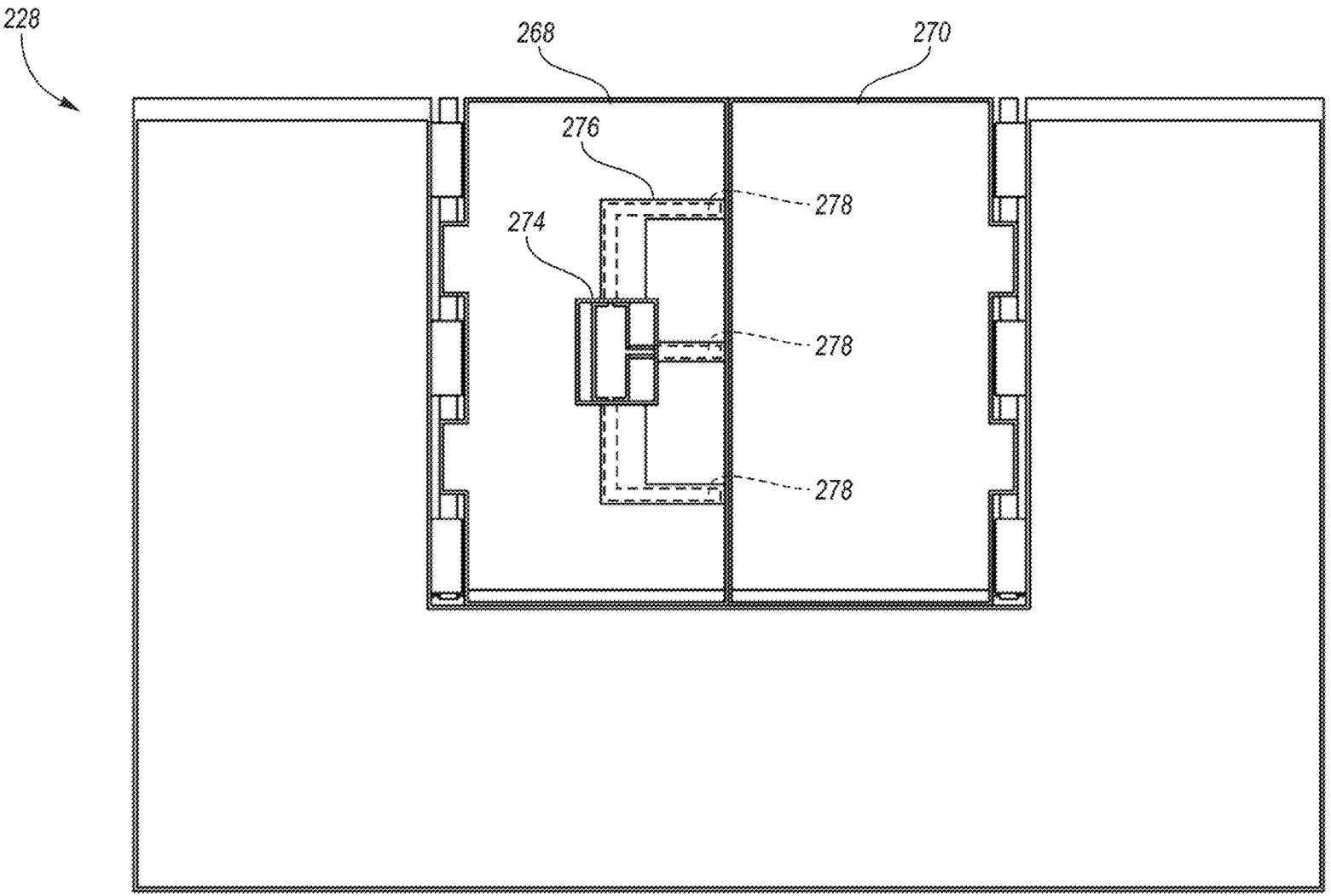
FIG. 18 shows the wall of FIG. 17 with the horizontally slidable latch has slid to the unlatched position.
Figure 19:
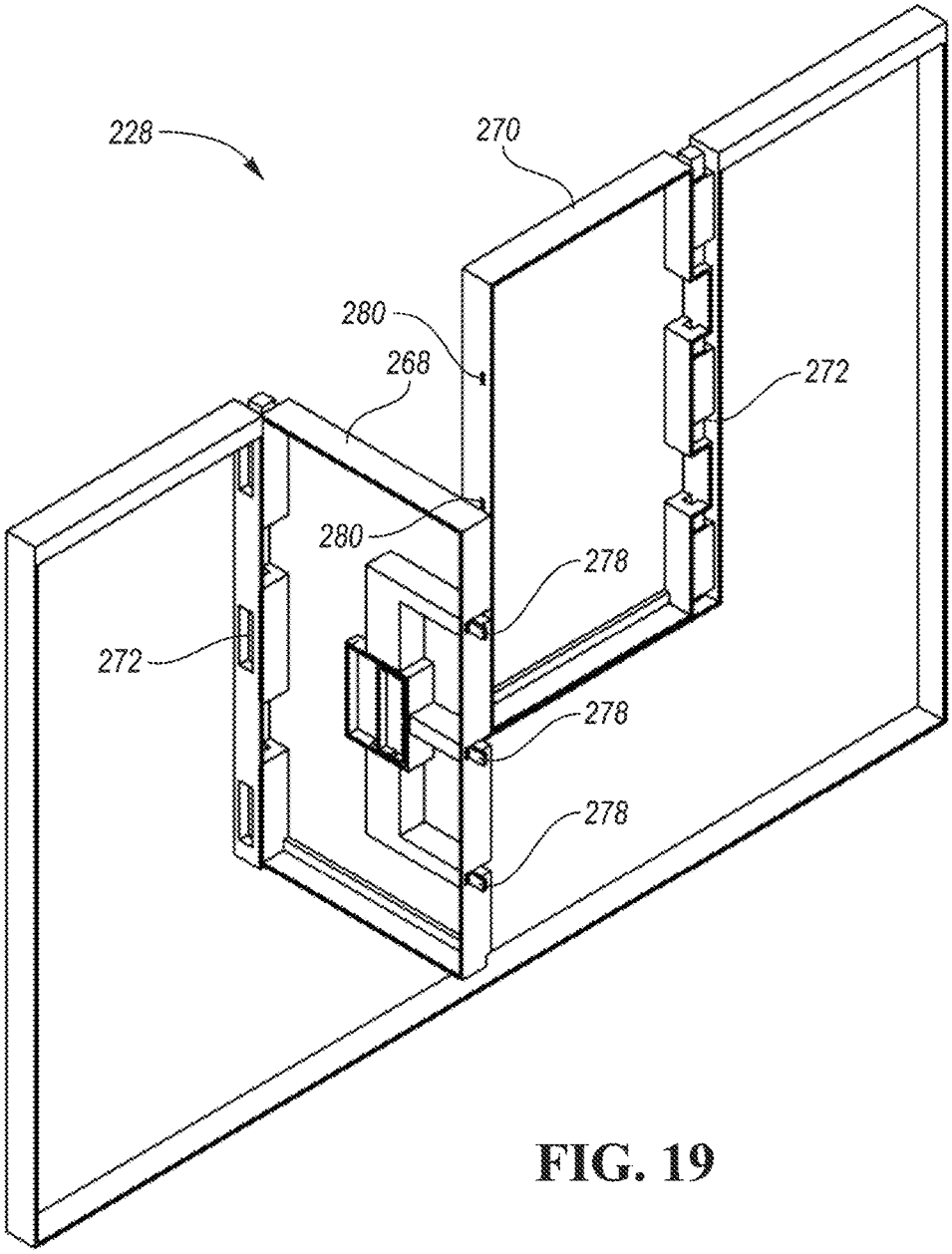
FIG. 19 is an exterior perspective view of one of the doors of the wall of FIG. 18 pivoted outwardly.

In FIG. 18, the horizontally slidable latch 274 has been slid to the left, such that the plurality of protruding ends 278 are removed from the second door 270. As shown in FIG. 19, the first door 268 can then be pivoted outwardly on its vertical hinges 272. The second door 270 can also be pivoted outwardly on its vertical hinges 272.

Figure 20:
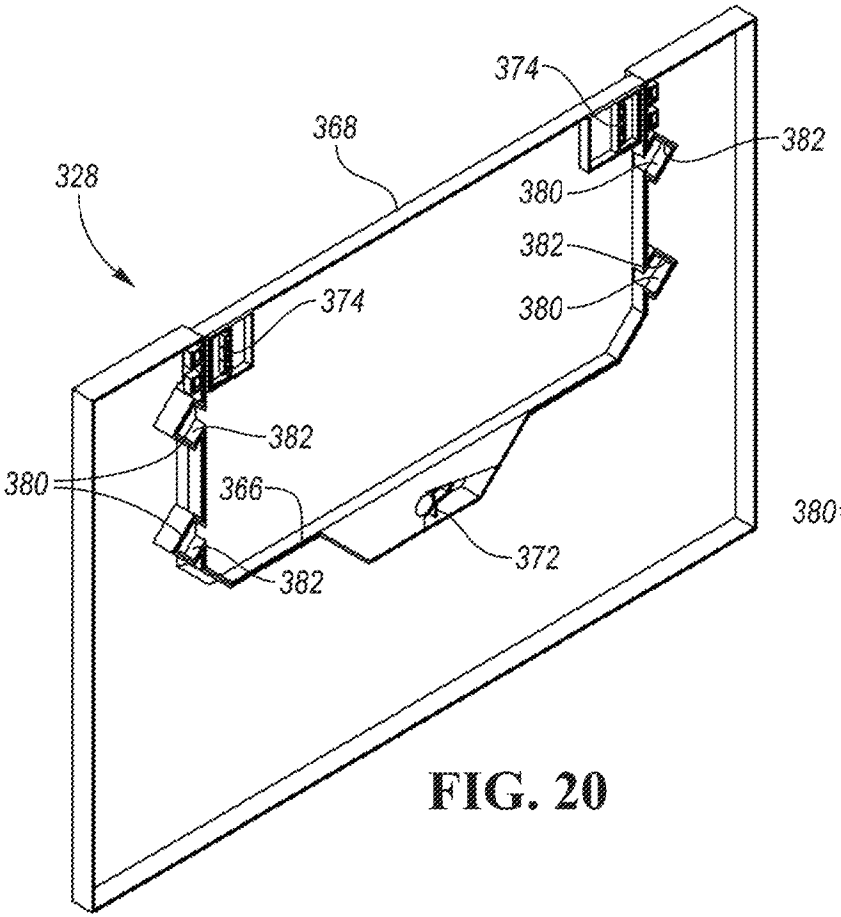
FIG. 20 is an exterior perspective view of a wall according to a fourth embodiment that could be used in the pallet bin of FIG. 1 or a similar pallet bin.

FIG. 20 shows a wall 328 according to a fourth embodiment that could be used in place of one or more of the walls of the pallet bin of FIG. 1 or a similar pallet bin. The wall 328 could have the ribbed structure similar to that of the first embodiment. The wall 328 includes an access opening 366 in which a door 368 is received. The door 368 is connected to the remainder of the wall 328 by a cam system 372 at a lower end thereof. The door 368 is also connected by horizontally slidable latches 374 at upper side edges thereof that are partially received in the panel 330 of the wall 328 in the latched position. The door 368 includes a plurality of interlocking projections 380 that interlock with recesses or openings 382 formed in the panel 330 at side edges of the access opening 366.

The access opening 366 opens upward through the uppermost edge of the wall 328. The access opening 366 is between approximately 40% and approximately 70% of the width of the wall 328, and more preferably approximately 66% of the width of the wall 328. The access opening 366 is between approximately 40% and approximately 70% of the height of the wall 328, and more preferably approximately 50% of the height of the wall 328.

Figure 21:
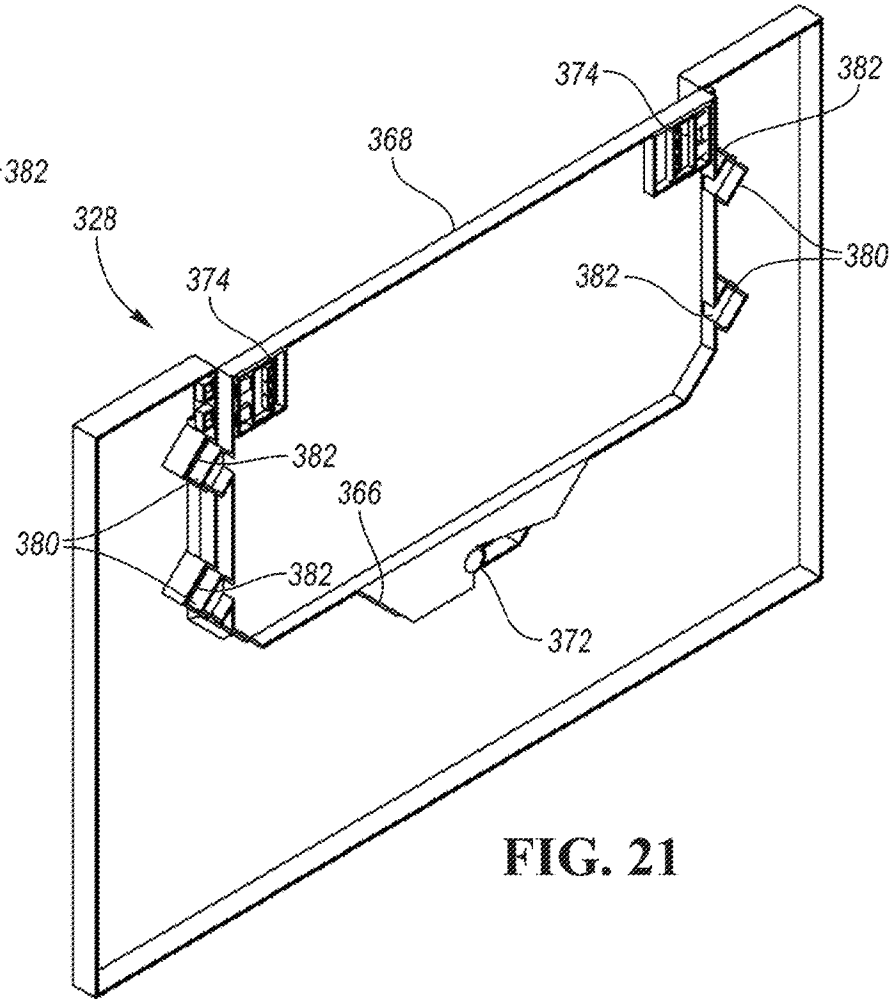
FIG. 21 shows the wall of FIG. 21 with the latches moved to an unlatched position and the door translated outward of the opening through the wall.
Figure 23:
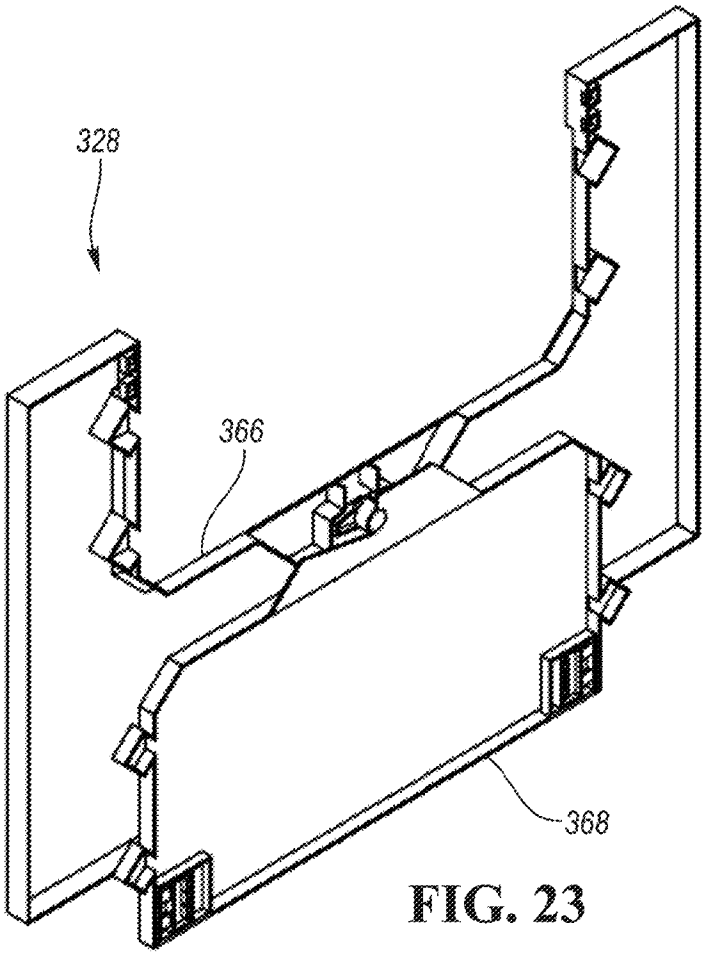
FIG. 23 shows the door of FIG. 22 rotated fully downward.
Figure 22:
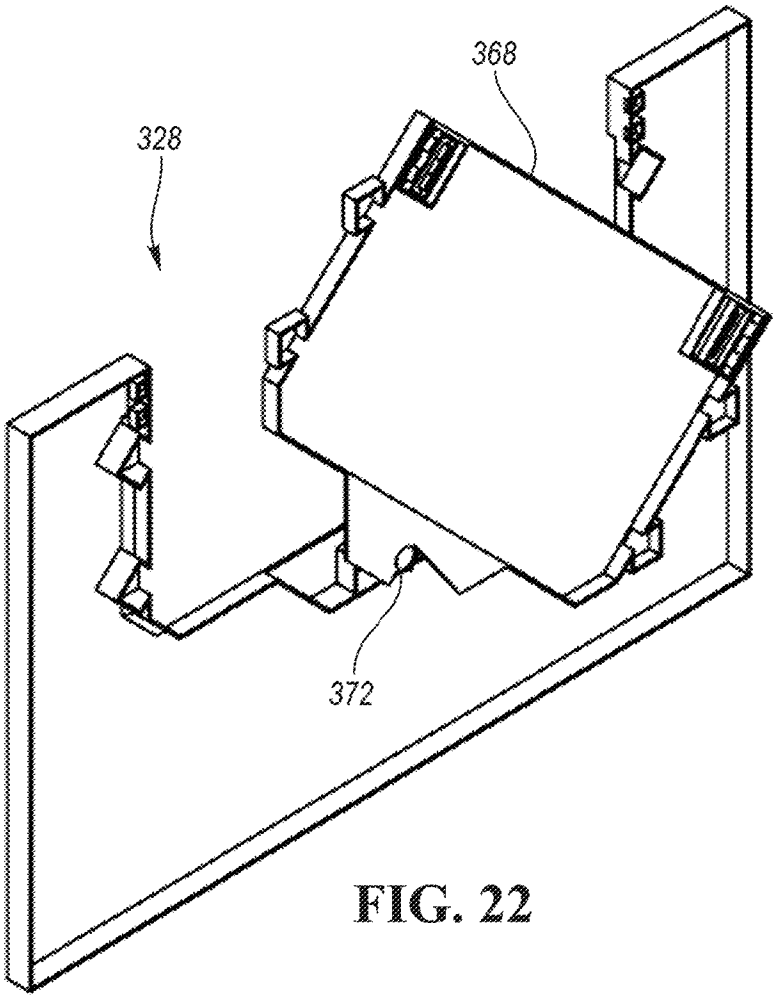
FIG. 22 shows the door of FIG. 21 partially rotated downward.

As shown in FIG. 21, to open the door 368, the horizontally slidable latches 374 are moved toward one another. The door 368 can then be translated outward in a direction perpendicular to the plane of the door 368. This removes the plurality of interlocking projections 380 from the openings 382. As shown in FIGS. 22 and 23, the door 368 can then be rotated downward on the cam system 372 to a position below the access opening 366 adjacent the remainder of the wall 328.

Figure 24:
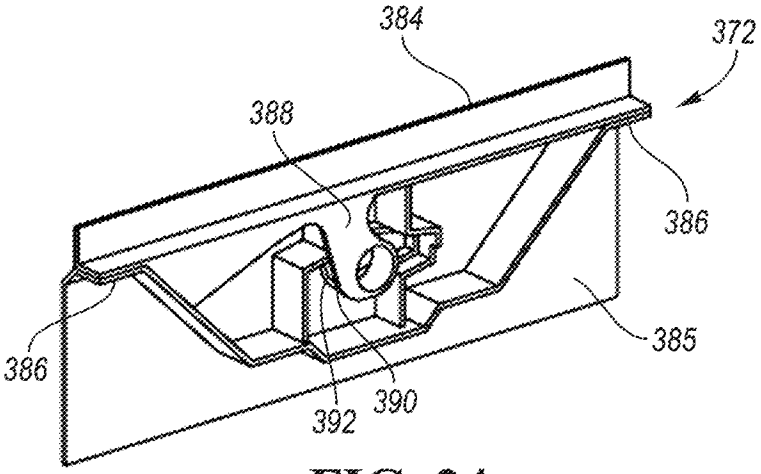
FIG. 24 shows the cam system for the door of FIGS. 20 to 23 in the closed position.

FIGS. 24 to 27 show the cam system 372 in more detail. FIG. 24 shows the cam system 372 in the closed position. The cam system 372 includes an arm 388 extending downward from a lower portion 384 of the door 368 (FIG. 22). The arm 388 may be integrally molded with the door 368 as a single piece of plastic. The lower portion 384 is pivotably connected to a lower bracket 385, which has upper platforms 386 on which the lower portion 384 of the door 368 (FIG. 20) rests in the closed position. The arm 388 extends downward to a shaft 390 received in an opening 392 in the lower bracket 385. The shaft 390 is rotatable about the axis of the shaft 390 within the opening 392. The axis of the shaft 390 is perpendicular to the wall 328 (FIG. 22). The shaft 390 is also slidable axially in the opening 392. The lower bracket 385 is molded integrally as a single piece of plastic with the wall 328 (FIG. 23).

Figure 25:
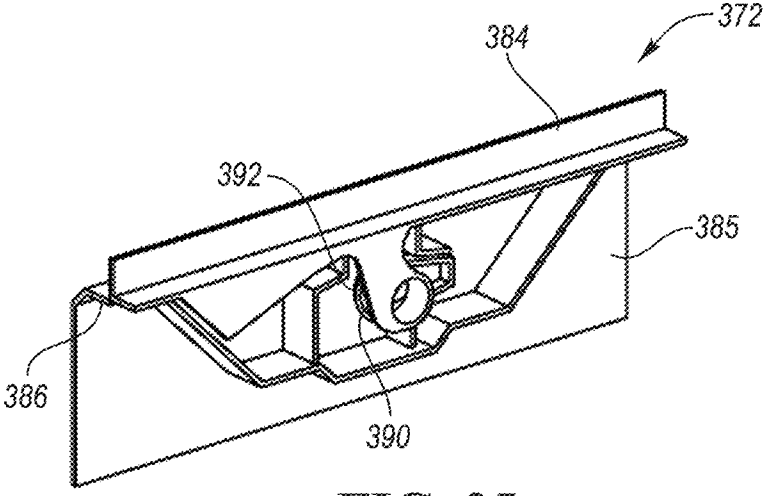
FIG. 25 shows the cam system of FIG. 24 moved to the unlatched position corresponding to FIG. 21.

To open the door, after releasing the latches 374 (FIGS. 20-21) the door 368 is first slid outward relative to the lower bracket 385 to where the lower portion 384 of the door 368 is no longer supported by the lower bracket 385, as shown in FIG. 25. The shaft 390 slides outward relative to the opening 392. The lower portion 384 is clear of the upper platforms 386. FIG. 25 corresponds to FIG. 21.

Figure 26:
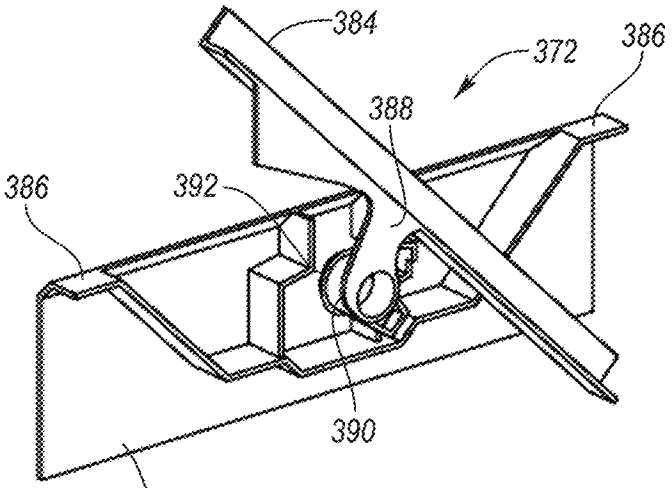
FIG. 26 shows the cam system of FIG. 24 in a partially rotated position corresponding to FIG. 22.
Figure 27:
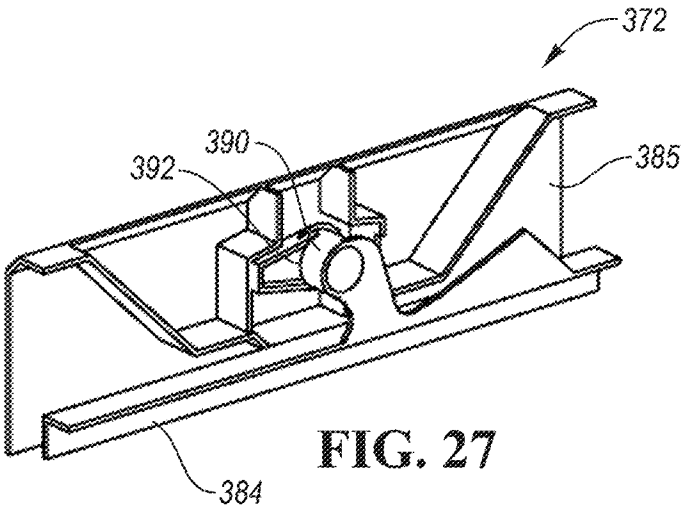
FIG. 27 shows the cam system of FIG. 24 in the fully rotated position corresponding to FIG. 23.

The lower portion 384 (and door 368) is then rotated relative to the lower bracket 385 as shown in FIG. 26 (which corresponds to FIG. 22) to a position 180 degrees away from the original, closed position of FIG. 24 to an open position shown in FIG. 27. The door 368 is rotated about the axis of the shaft 390. FIG. 27 corresponds to FIG. 23.

Figure 31:
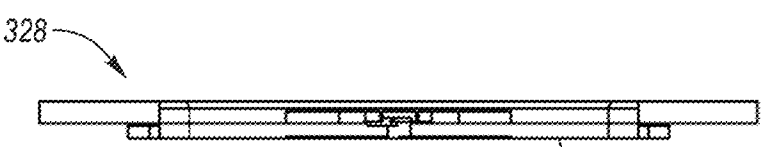
FIG. 31 is a top view of the wall of FIG. 30.
Figure 30:
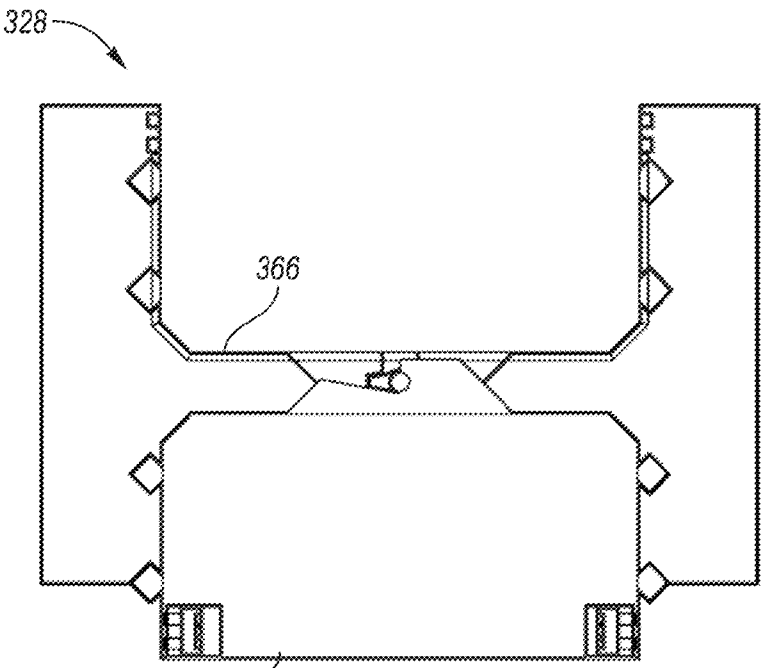
FIG. 30 is a front view of the wall of FIG. 23 with the door in the fully open position.
Figure 29:
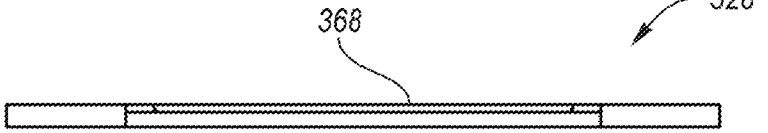
FIG. 29 is a top view of the wall of FIG. 28.
Figure 28:
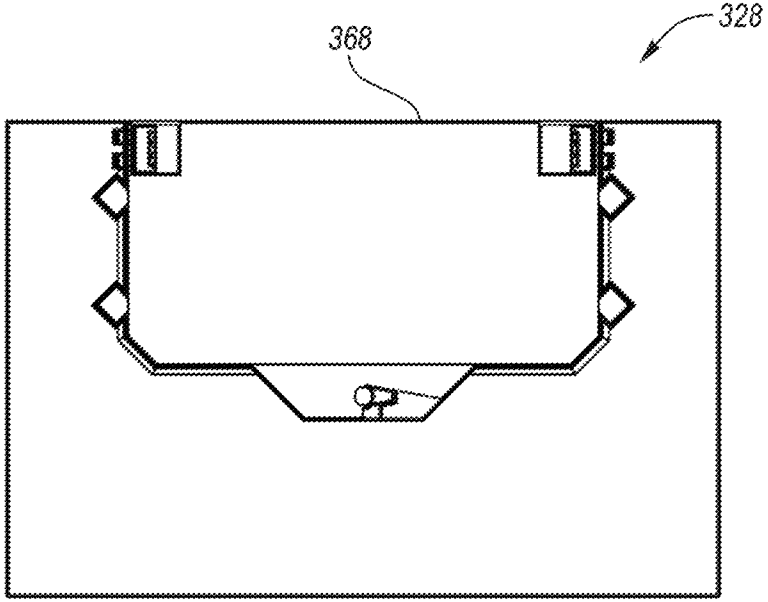
FIG. 28 is a front view of the wall of FIG. 20 with the door in the closed position.

FIGS. 28 and 30 are front views of the wall 328. FIGS. 29 and 31 are top views of the wall 328. In FIGS. 28 and 29, the door 368 is closed. In FIGS. 30 and 31, the door is open.

The wall 328, the door 368 and the horizontally slidable latches 374 may be injection molded of a suitable plastic. The cam system 372 is integrally molded with the door 368 and the wall 328. Alternatively, some components of the cam system 372 could be metal and insert-molded with the door 368 and/or the wall 328.

Figure 32:
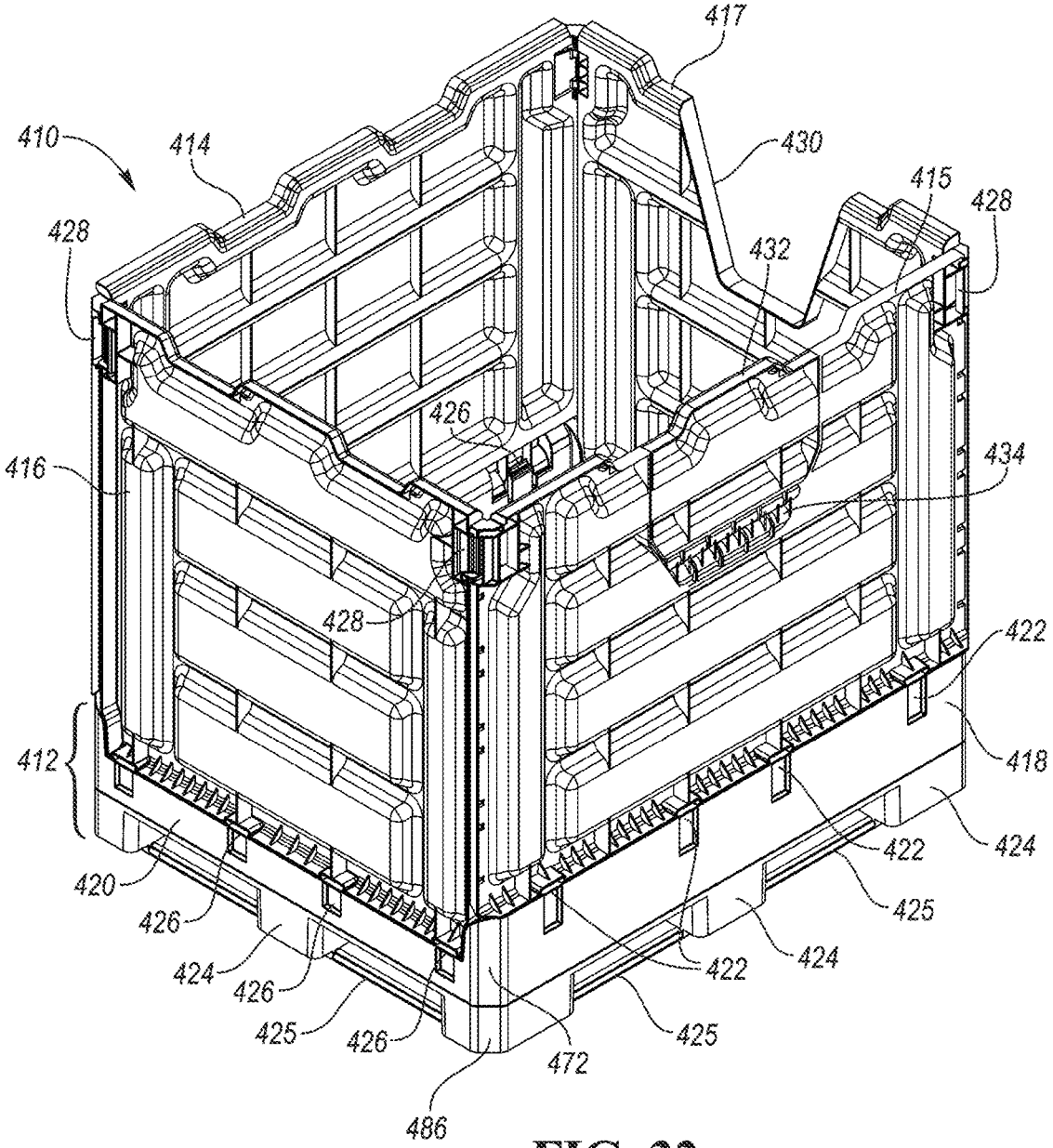
FIG. 32 shows a pallet bin according to another embodiment.

FIG. 32 shows a pallet bin 410 according to another embodiment. The pallet bin 410 includes a base 412. A first wall 414, a second wall 415, a third wall 416, and a fourth wall 417 are all hingeably connected to the base 412. The first wall 414 and the second wall 415 are hingeably connected to side upstanding portions 418 of the base 412 by hinges 426. The first wall 414 and second wall 415 may be considered side walls for convenience, although this terminology is not limiting. The third wall 416 and fourth wall 417 are hingeably connected to end upstanding portions 420 of the base 412 by hinges 422. The third wall 416 and fourth wall 417 may be considered end walls for convenience, although this terminology is not limiting.

The base 412 includes a plurality of columns 424 defining tine openings therebetween. The base 412 includes an upper base portion 472 and a lower base portion 486. The upper base portion 472 includes the side upstanding portions 418 and the upstanding portions 420. The lower base portion 486 includes the plurality of columns 424. Latches 428 selectively connect the first wall 414 and second wall 415 to the third wall 416 and fourth wall 417.

In the example pallet bin 410 shown in FIG. 32, the fourth wall 417 includes an access opening 430 therein. The access opening 430 is a permanent opening, i.e. there is no door. The access opening 430 is tapered with angled sides such that the lower portion of the access opening 430 is narrower than the upper portion, which opens through the uppermost edge of the fourth wall 417. This provides access to the interior of the pallet bin 410 to a user's arm or to a hook.

The third wall 416 includes an access opening 456 selectively closed by a door 432 connected by a hinge member 434 hingeably connected to the door 432 and hingeably connected to the third wall 416.

Figure 33:
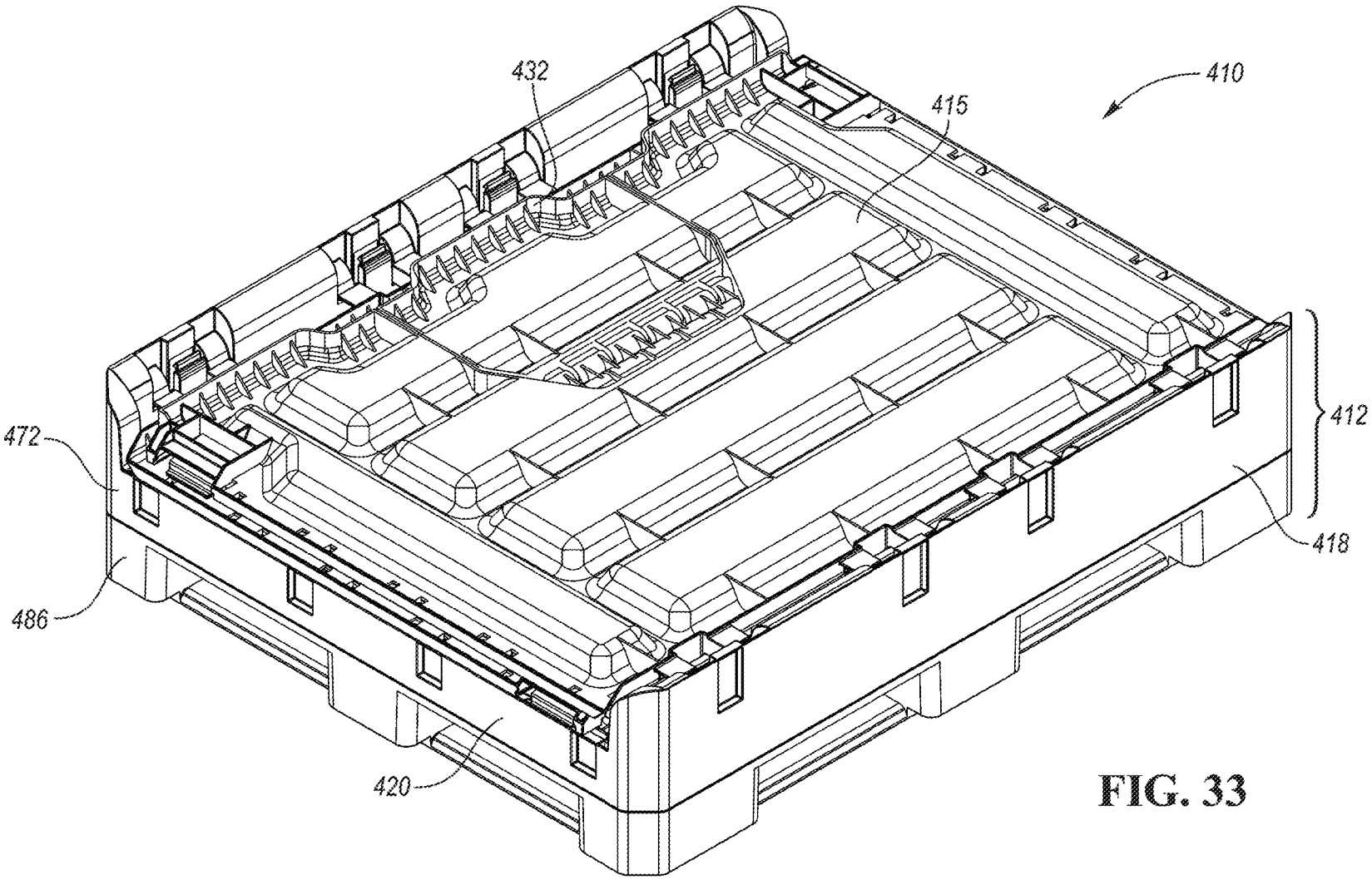
FIG. 33 is a perspective view of the pallet bin of FIG. 32 in the collapsed position.

FIG. 33 is a perspective view of the pallet bin 410 in the collapsed position. The walls are collapsed onto the base 412. In FIG. 33-, the second wall 415 is on top of the first wall 414, but the second wall 415 could be collapsed before the first wall 414. The third wall 416 and fourth wall 417 are below the first wall 414 and second wall 415.

Figure 34:
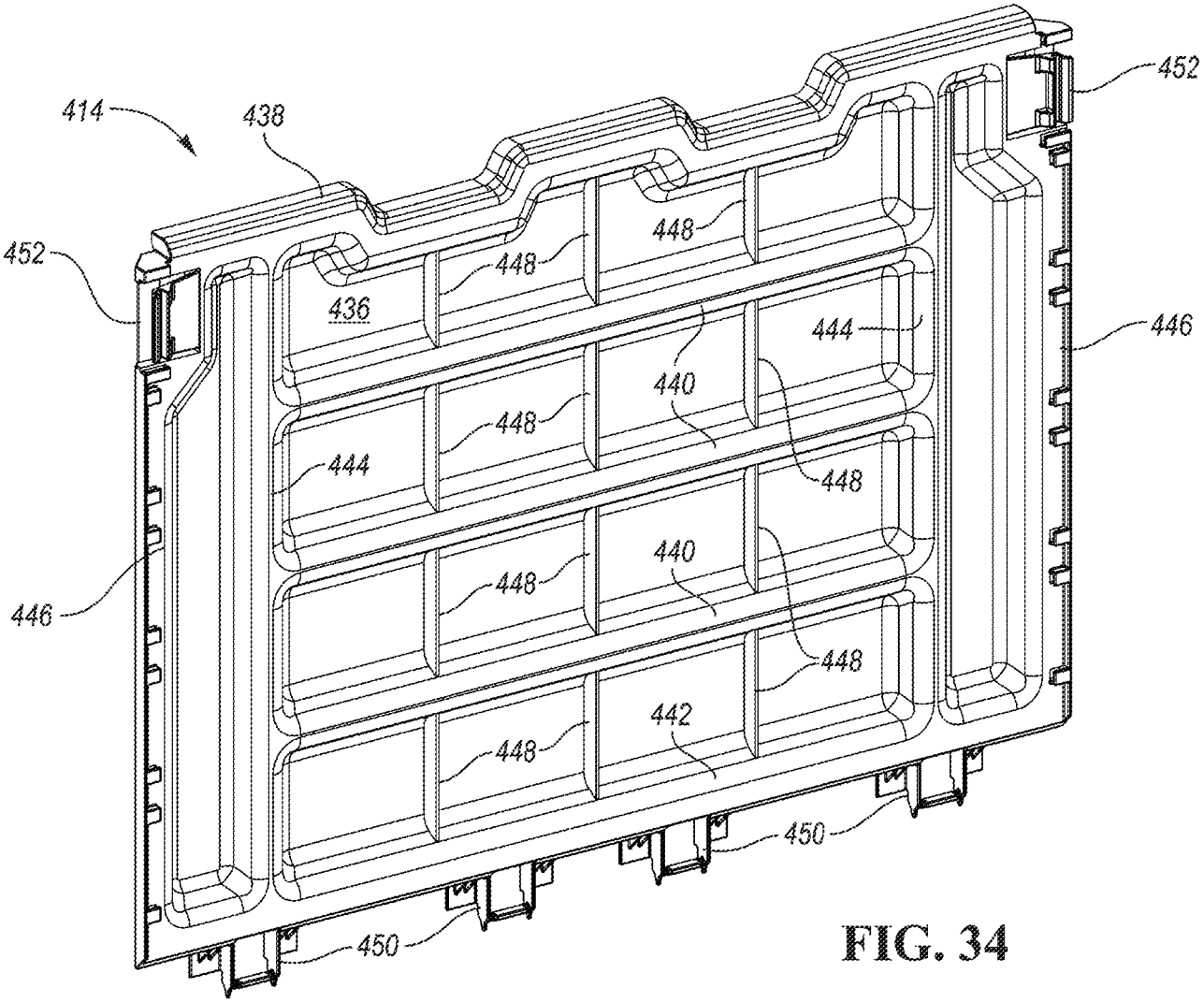
FIG. 34 is an interior perspective view of the first wall of the pallet bin of FIG. 32.

FIG. 34 is an interior perspective view of the first wall 414. The first wall 414 is integrally molded as a single piece of suitable plastic. The first wall 414 includes a plurality of horizontal inward corrugations 440 connected by a plurality of vertical ribs 448 projecting inward from an outer panel 436. The outer panel 436 curves inward and then back outward to form each of the plurality of horizontal inward corrugations 440. The first wall 414 includes a pair of outer vertical inward corrugations 444. The outer panel 436 curves inward and then back outward to form each of the outer vertical inward corrugations 444. The plurality of horizontal inward corrugations 440 connect the outer vertical inward corrugations 444. Outer vertical flanges 446 project inward to define lateral edges of the first wall 414. The interior surface of the first wall 414 does not include any horizontal ribs, i.e. no horizontal surfaces that project at 90 degrees from the outer panel 436. The first wall 414 only includes the plurality of horizontal inward corrugations 440, which provide more gradual contours, without hard 90-degree corners or surfaces. This facilitates the flow of liquids over the first wall 414 during washing and prevents any product or bacteria from being trapped in sharp corners. The plurality of vertical ribs 448 permit liquid to drain downward.

As used herein, a "rib" projects outward from a panel that is otherwise substantially planar on either side of the rib. A "corrugation" is where the panel itself curves out of its original plane in one direction and then back in the opposite direction to (or close to) the panel's original plane, also forming a complementary recess on the opposite side. A "flange" is an edge of a panel that projects transversely relative to the plane of the panel adjacent the flange, but where the panel does not continue on the opposite side of the flange.

Each of the first wall 414, the second wall 415, the third wall 416 and the fourth wall 417 has the same basic structure (i.e. outer panel 436, plurality of horizontal inward corrugations 440, outer vertical flanges 446, plurality of vertical ribs 448, interior form horizontal elongated recesses 441) with different options, such as the access opening 430 and the door 432, but optionally all four or any number less than four of the walls could be similar to any of the first wall 414, the second wall 415, the third wall 416 or the fourth wall 417).

Figure 35:
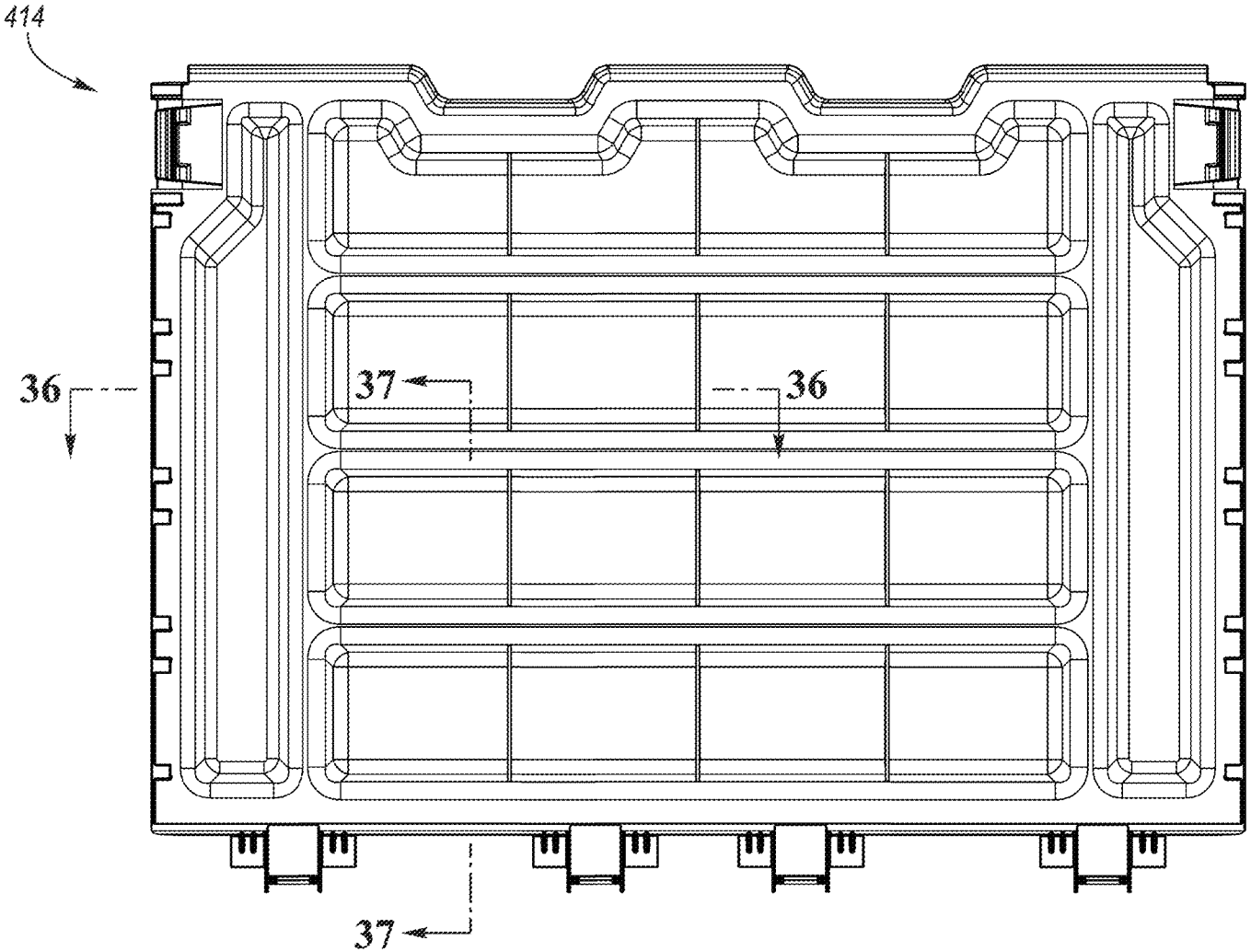
FIG. 35 is an interior view of the first wall of FIG. 34.

FIG. 35 is an interior view of the first wall 414.

Figure 36:
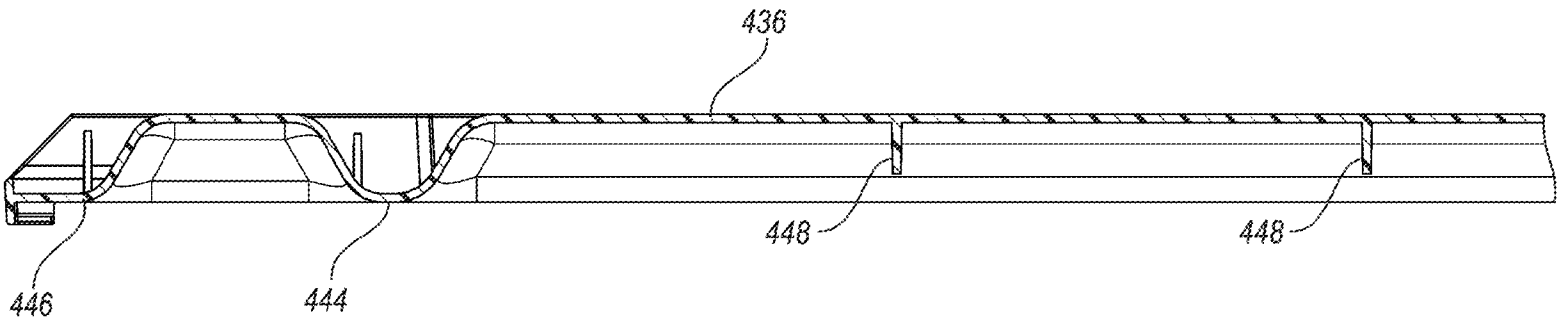
FIG. 36 is a section view through the first wall of FIG. 35 taken along line 36-36.

FIG. 36 is a section view through the first wall 414 of FIG. 35 taken along line 36-36. As shown, the plurality of vertical ribs 448 project inward from the outer panel 436. The outer vertical inward corrugations 444 project inward perpendicularly from the outer panel 436. The outer vertical flanges 446 project inward from the outer panel 436.

Figure 37:
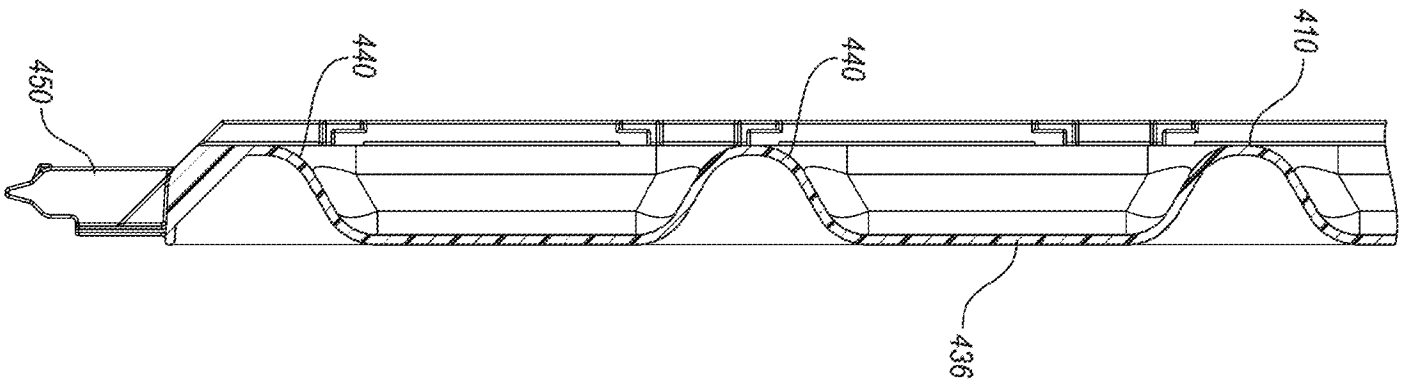
FIG. 37 is a section view through the first wall of FIG. 35 taken along line 37-37.

FIG. 37 is a section view through the first wall 414 of FIG. 35 taken along line 37-37. As shown, the plurality of horizontal inward corrugations 440 curve continuously inward from the outer panel 436 without sharp angles. The transitions from the outer panel 436 to the plurality of horizontal inward corrugations 440 are curved. This facilitates the flow of liquids over the first wall 414 during washing and prevents any product or bacteria from being trapped in sharp corners.

Figure 38:
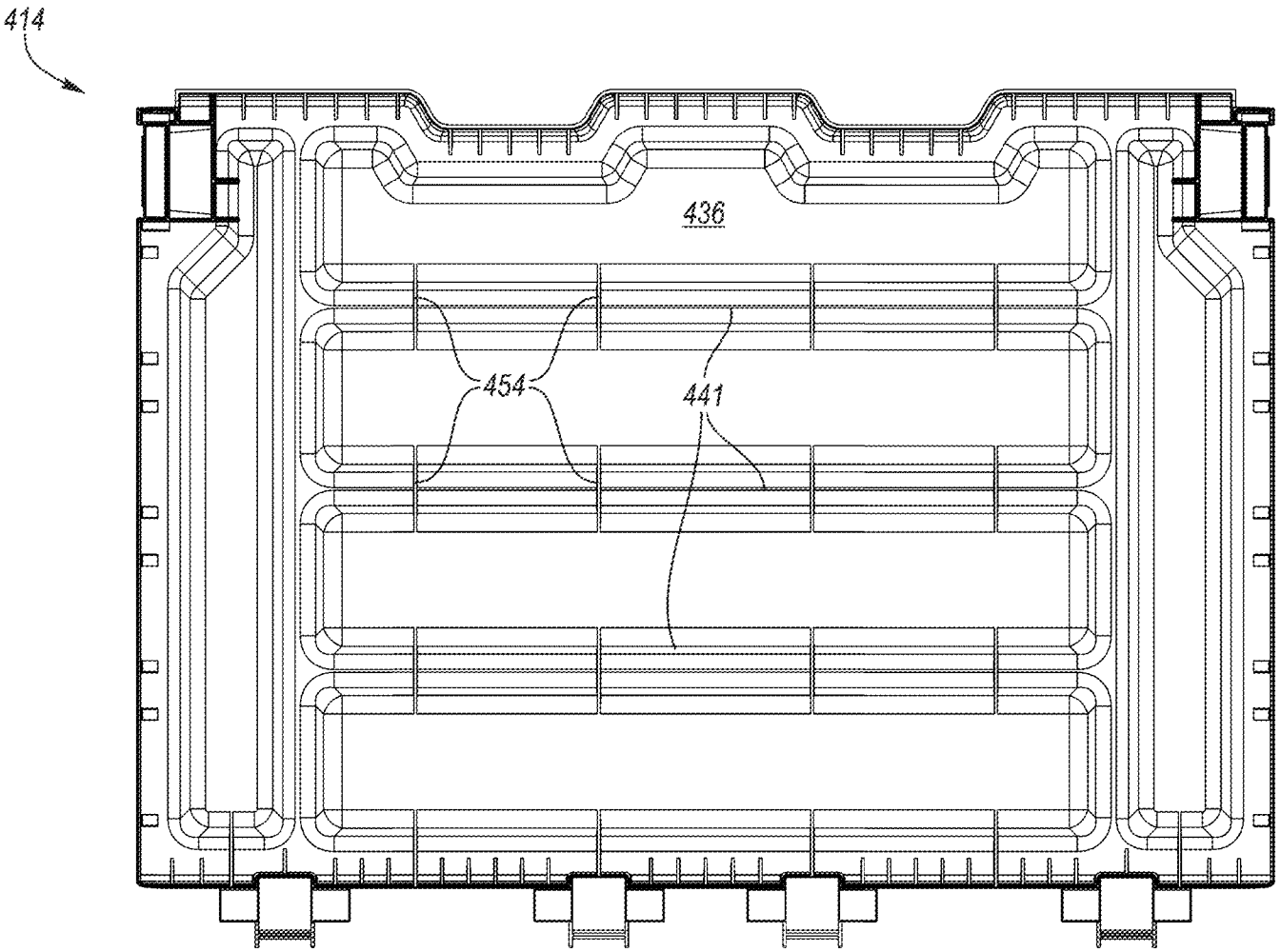
FIG. 38 is an exterior view of the first wall.

FIG. 38 is an exterior view of the first wall 414. The exterior surface of the outer panel 436 is visible. The plurality of horizontal inward corrugations 440 (FIG. 37) of the interior form horizontal elongated recesses 441 on the exterior surface of the first wall 414. Vertical ribs 454 extend vertically across the horizontal elongated recesses 441. The vertical ribs 454 are offset laterally from the plurality of vertical ribs 448 (FIG. 34) on the interior side of the first wall 414.

Figure 39:
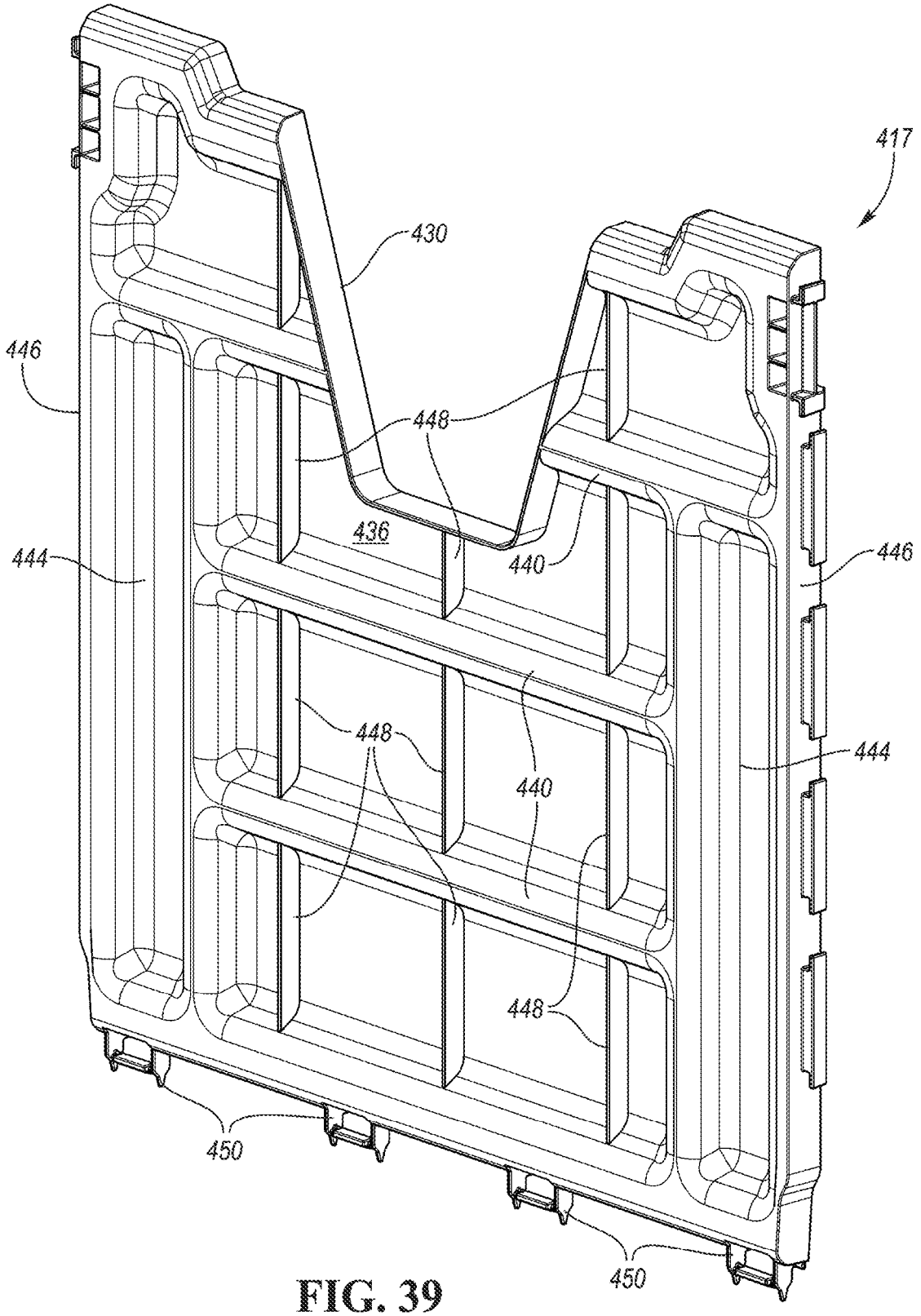
FIG. 39 is an interior perspective view of the fourth wall of the pallet bin of FIG. 32.

FIG. 39 is an interior perspective view of the fourth wall 417. The fourth wall 417 is molded as a single piece of suitable plastic. The fourth wall 417 includes a plurality of horizontal inward corrugations 440 connected by a plurality of vertical ribs 448 projecting inward from an outer panel 436. The plurality of horizontal inward corrugations 440 curve inward from the outer panel 436. The fourth wall 417 includes a pair of outer vertical inward corrugations 444. The plurality of horizontal inward corrugations 440 connect the outer vertical inward corrugations 444. Outer vertical flanges 446 project inward to define lateral edges of the fourth wall 417. This facilitates the flow of liquids over the second wall 415 during washing and prevents any product or bacteria from being trapped in sharp corners. The plurality of vertical ribs 448 already permit liquid to drain downward.

Figure 41:
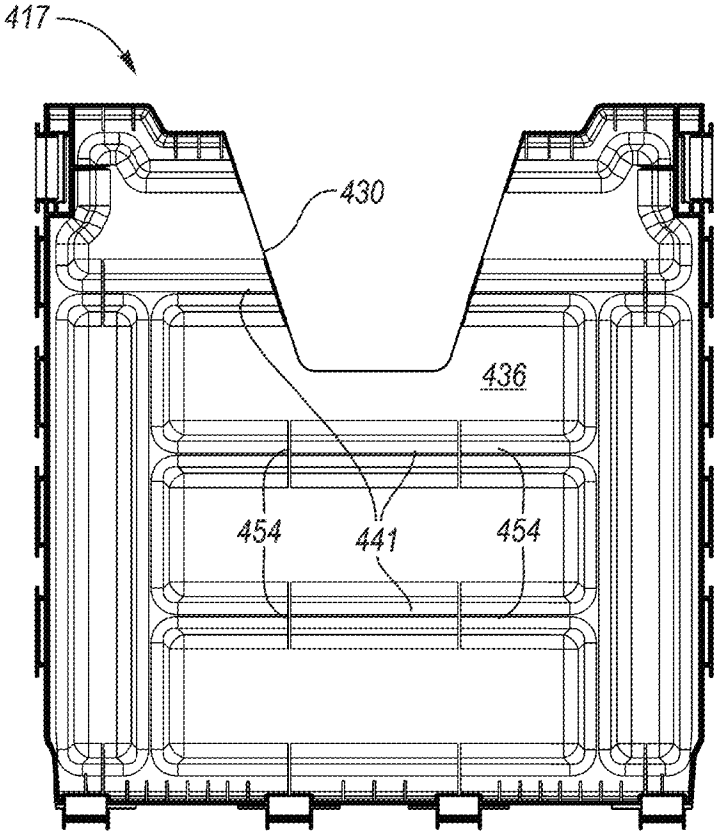
FIG. 41 is an exterior view of the fourth wall of FIG. 39.
Figure 40:
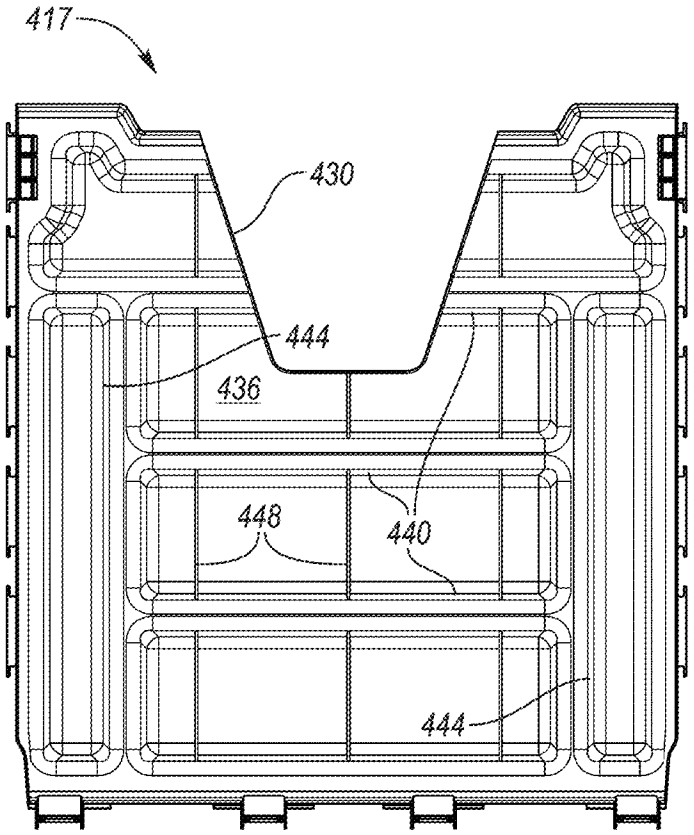
FIG. 40 is an interior view of the fourth wall of FIG. 39.

FIG. 40 is an interior view of the fourth wall 417. FIG. 41 is an exterior view of the fourth wall 417. The fourth wall 417 includes the access opening 430 therein. The access opening 430 is a permanent opening, i.e. there is no door. The access opening 430 is tapered with angled sides such that the lower portion of the access opening 430 is narrower than the upper portion, which opens through the uppermost edge of the fourth wall 417. The access opening 430 is defined by an inwardly-projecting wall that projects inward from the outer panel 436 and intersects one of the plurality of horizontal inward corrugations 440 and one of the plurality of vertical ribs 448.

Figure 42:
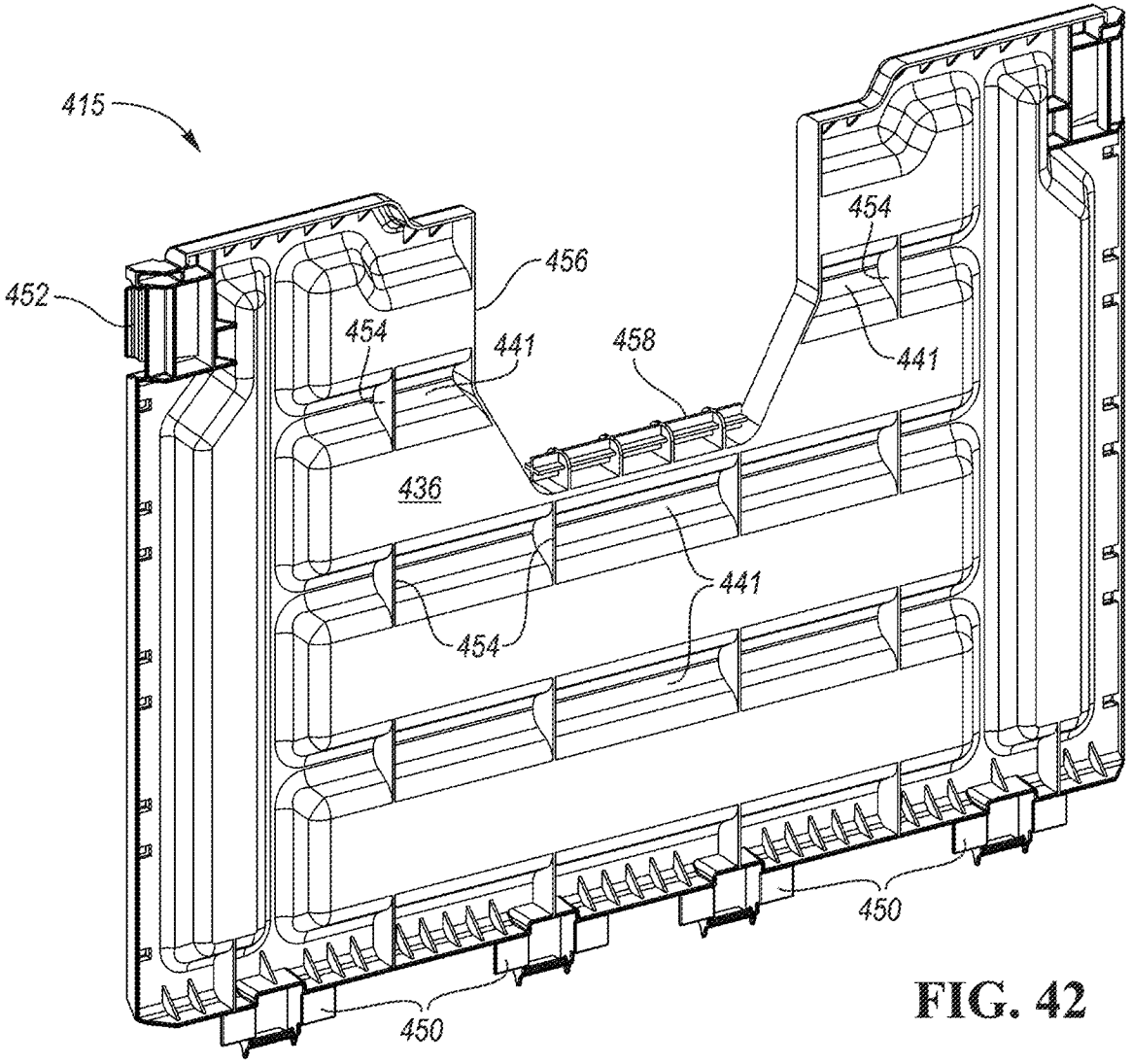
FIG. 42 is an exterior perspective view of the second wall of the pallet bin of FIG. 32.

FIG. 42 is an exterior perspective view of the second wall 415. The second wall 415 is molded as a single piece of suitable plastic. The exterior surface of the outer panel 436 defines the outer most surface of the second wall 415. The plurality of horizontal inward corrugations on the interior surface form horizontal elongated recesses 441 on the exterior surface of the second wall 415. Vertical ribs 454 extend vertically across the interior form horizontal elongated recesses 441. The vertical ribs 454 are offset laterally from the plurality of vertical ribs on the interior side of the second wall 415 (similar to the first wall 414).

Figure 43:
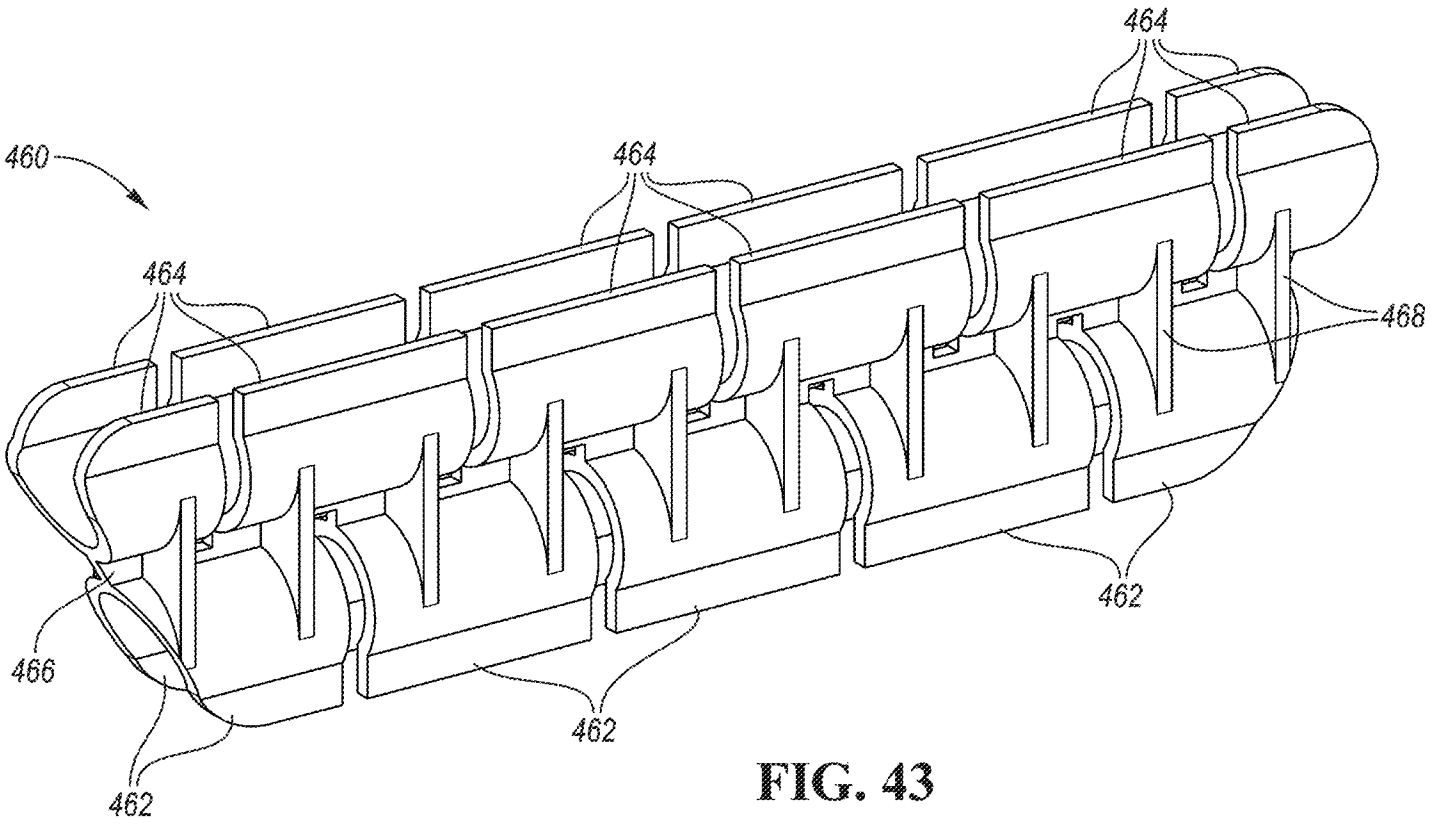
FIG. 43 is a perspective view of the hinge member of the pallet bin of FIG. 32.

FIG. 43 is a perspective view of the hinge member 460. The hinge member 460 is integrally molded as a single piece of plastic. The hinge member 460 includes a plurality of lower knuckle portions 462 projecting downward and a plurality of upper knuckle portions 464 projecting upward from a central body 466. A plurality of perpendicular ribs 468 reinforce the plurality of lower knuckle portions 462 and plurality of upper knuckle portions 464. The hinge member 460 shown in FIG. 43 is integrally molded as a single piece of plastic; however, alternatively, two or three axially shorter hinge members (e.g. each having only one, two or three lower knuckle portions 462 and two or three upper knuckle portions 464) could also be used on each door.

Figure 44:
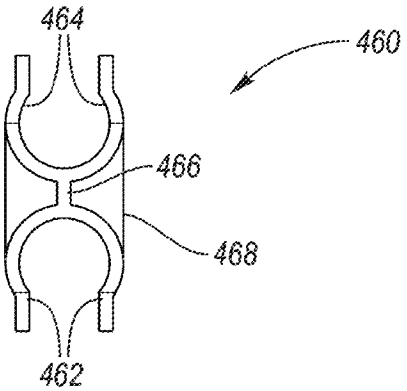
FIG. 44 is an end view of the hinge member of FIG. 43.

FIG. 44 is an end view of the hinge member 460. Referring to FIGS. 43 and 44, the plurality of lower knuckle portions 462 are arranged in two spaced-apart lower rows and are concave opening inward to define a lower hinge pin-receiving channel therebetween. Similarly, the plurality of upper knuckle portions 464 are arranged in two spaced-apart upper rows and are concave opening inward to define an upper hinge pin-receiving channel therebetween.

Figure 45:
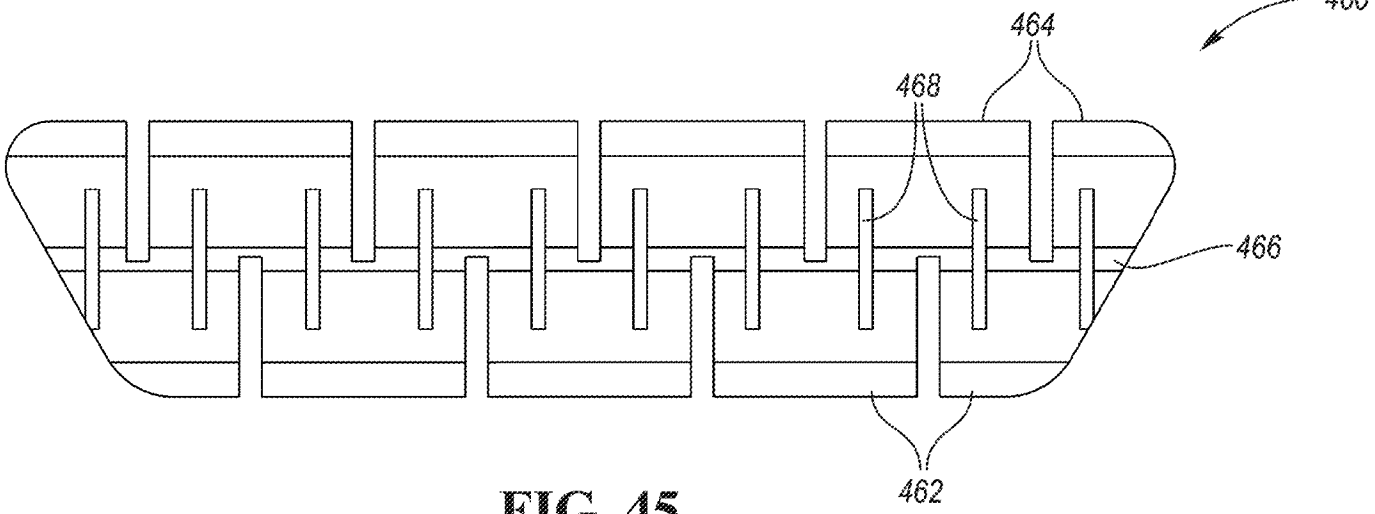
FIG. 45 is a side view of the hinge member of FIG. 43.

FIG. 45 is a side view of the hinge member 460. As shown, the plurality of lower knuckle portions 462 and plurality of upper knuckle portions 464 may be staggered laterally relative to one another. The plurality of perpendicular ribs 468 each reinforce one of the plurality of lower knuckle portions 462 and one of the plurality of upper knuckle portions 464.

Figure 46:
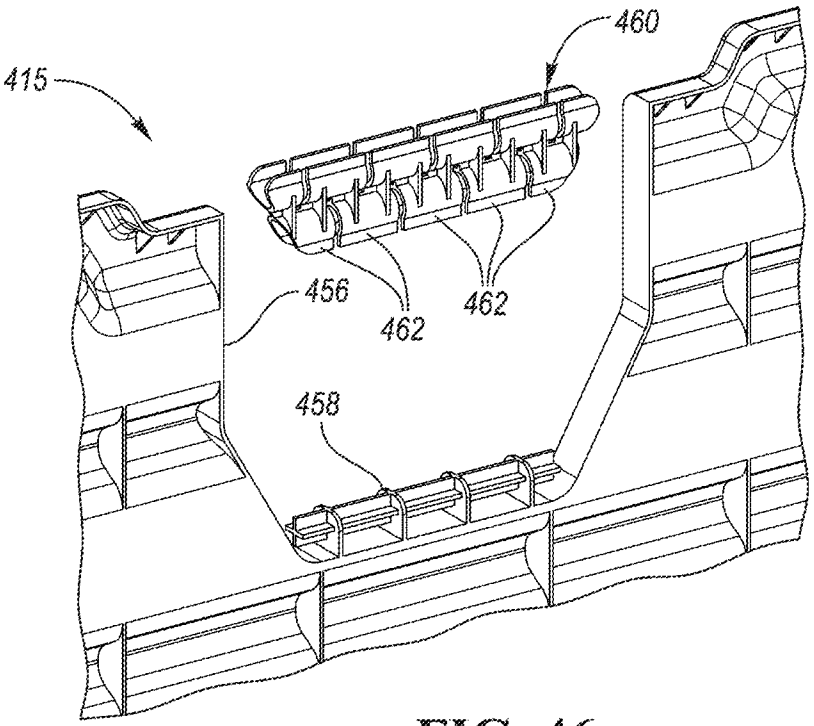
FIG. 46 is an enlarged view of the access opening in the second wall of the pallet bin of the pallet bin of FIG. 32 and the hinge member exploded from the hinge pin.

FIG. 46 is an enlarged view of the access opening 456 in the second wall 415 and the hinge member 460 removed from the lower hinge pin 458. The lower hinge pin 458 is integrally molded with the rest of the second wall 415. As shown, the lower hinge pin 458 includes two perpendicular ribs extending substantially the entire length of the bottom of the access opening 456 and a plurality of perpendicular ribs contiguous with the bottom of the access opening and extending through the two perpendicular ribs. The plurality of lower knuckle portions 462 are configured such that they can snap-fit over the two perpendicular ribs of the lower hinge pin 458 which would be received within the lower hinge receiving channel of the hinge member 460. The hinge member 460 would be rotatably coupled to the lower hinge pin 458.

Figure 47:
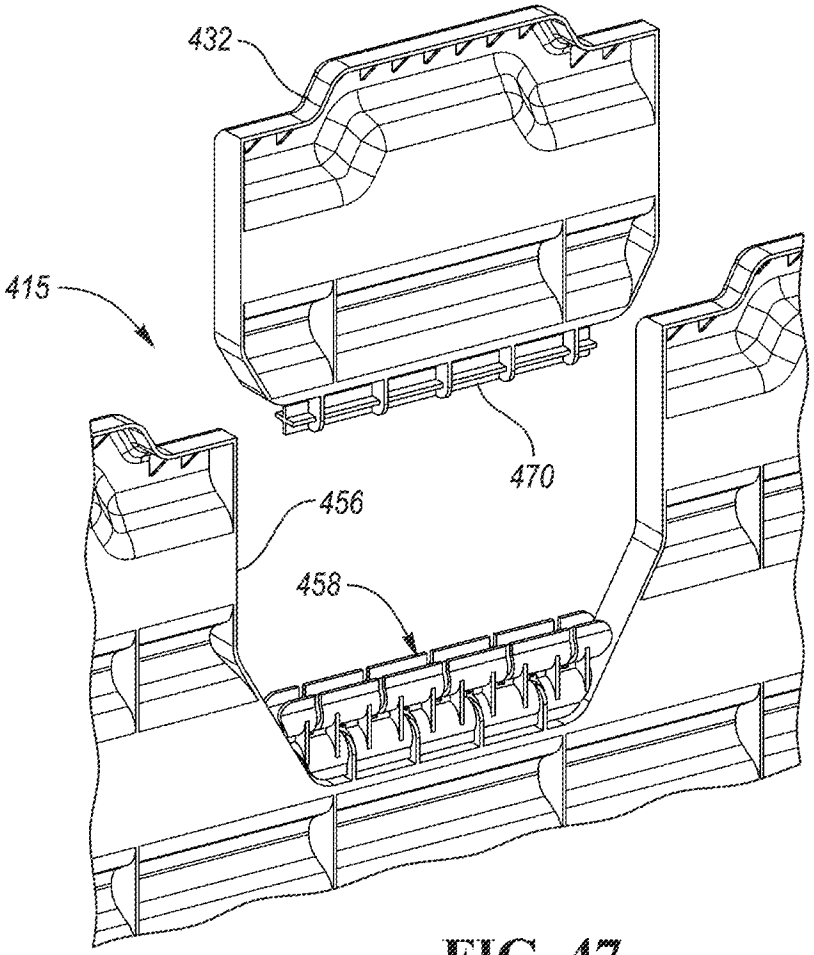
FIG. 47 shows the hinge member connected to the hinge pin of the second wall, with the door exploded from the hinge member.

Referring to FIG. 47, the door 432 includes an upper hinge pin 470 integrally molded with the rest of the door 432. The upper hinge pin 470 includes two perpendicular ribs extending substantially the entire length of the bottom of the door 432 and a plurality of perpendicular ribs contiguous with the bottom of the door 432 and extending through the two perpendicular ribs. The plurality of upper knuckle portions 464 are configured such that they can snap-fit over the two perpendicular ribs of the upper hinge pin 470 which would be received within the upper hinge receiving channel of the hinge member 460. The hinge member 460 would be rotatably coupled to the upper hinge pin 470.

Figure 48:
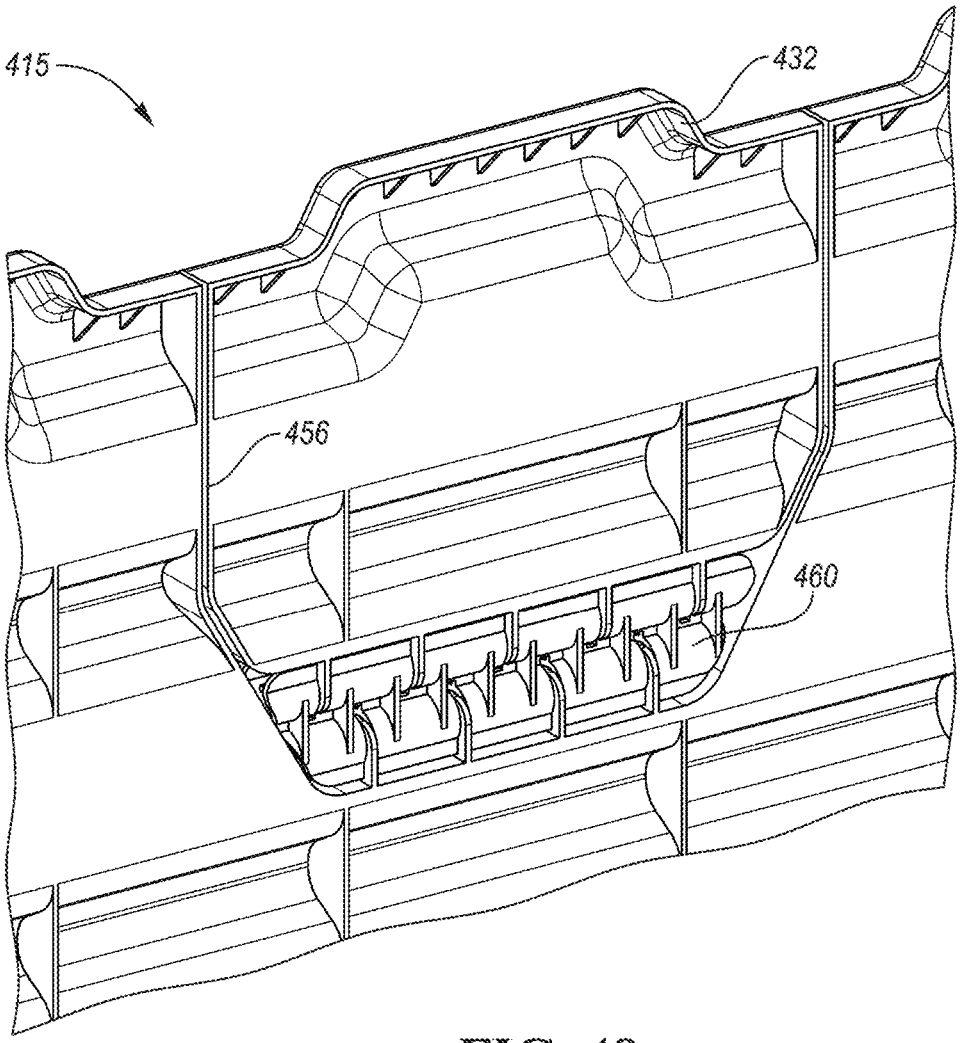
FIG. 48 shows the second wall, hinge member, and door of FIG. 47 assembled and with the door in the closed position over the access opening.

FIG. 48 shows the door 432 in the closed position over the access opening 456. Latches (not shown) would keep the door 432 closed and permit it to be selectively opened.

Figure 49:
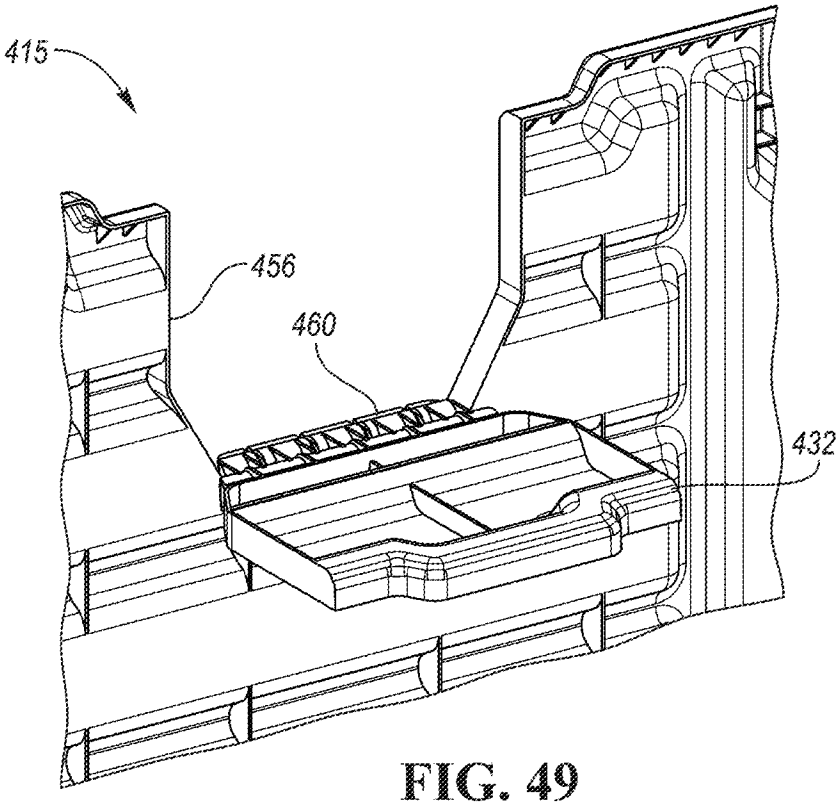
FIG. 49 shows the door of FIG. 48 in the partially open position.

FIG. 49 shows the door 432 in a partially open position, after the door 432 has been pivoted relative to the hinge member 460 and the hinge member 460 has been pivoted relative to the lower hinge pin 458.

Figure 50:
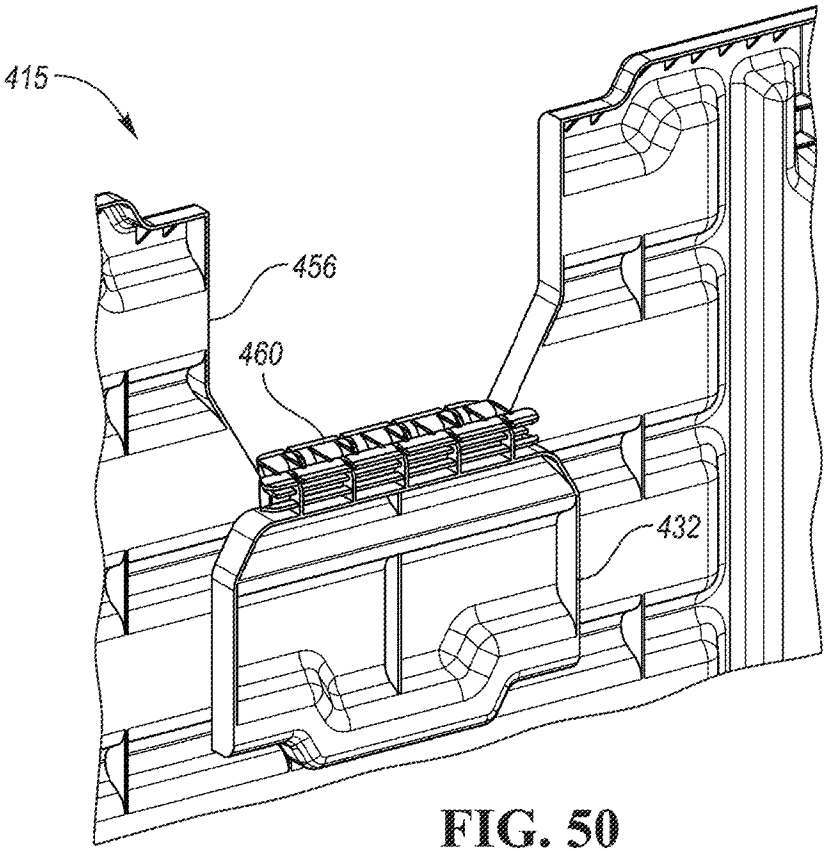
FIG. 50 shows the door of FIG. 48 pivoted to the fully open position against the exterior surface of the second wall and parallel to the second wall.

FIG. 50 shows the door 432 pivoted to the fully open position against the exterior surface of the second wall 415 and parallel to the second wall 415. This fully open position is enabled by the dual, spaced-apart hinges formed by the hinge member 460, lower hinge pin 458 and upper hinge pin 470.

Figure 51:
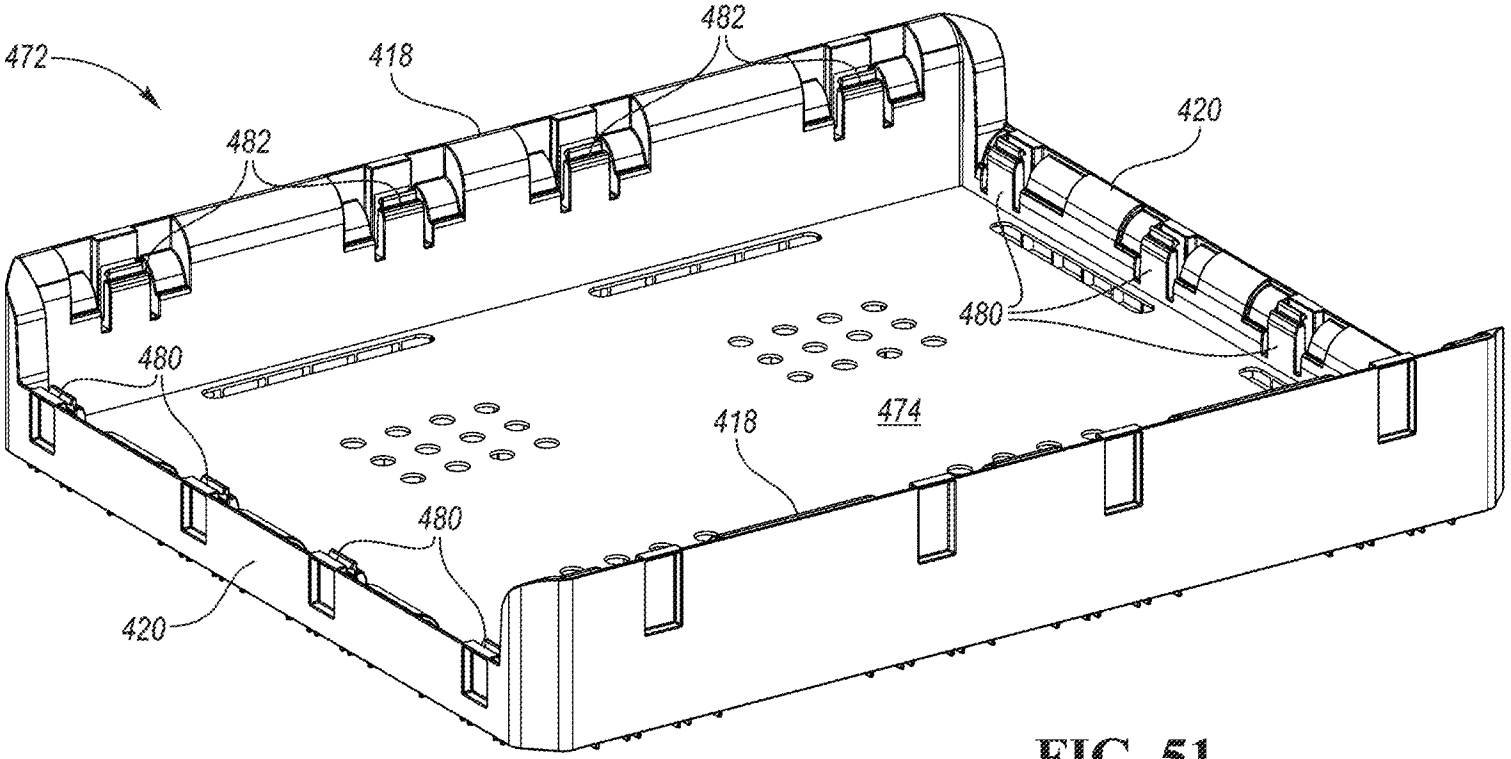
FIG. 51 is an upper perspective view of the upper base portion of the pallet bin of FIG. 32.

FIG. 51 is an upper perspective view of the upper base portion 472. The upper base portion 472 includes a generally planar upper support surface 474. The side upstanding portions 418 extend upward from side edges of the upper support surface 474. Side hinge receivers 482 are formed at upper ends of the side upstanding portions 418. The end upstanding portions 420 extend upward from end edges of the upper support surface 474. End hinge receivers 480 are formed at upper ends of the end upstanding portions 420.

Figure 52:
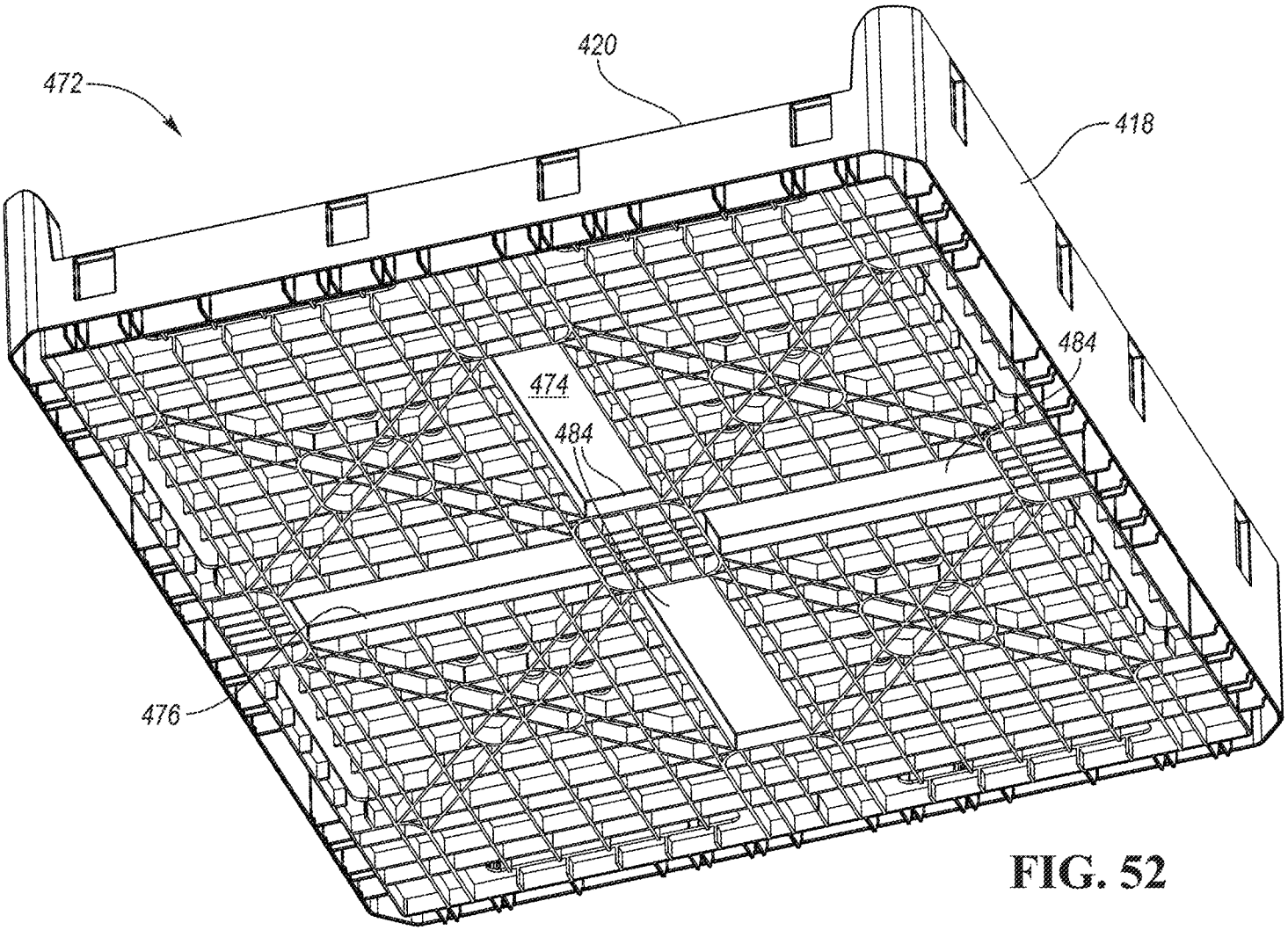
FIG. 52 is a bottom perspective view of the upper base portion of FIG. 51.

FIG. 52 is a bottom perspective view of the upper base portion 472. A plurality of intersecting ribs 476 project downward from the upper support surface 474. Recesses 484 are defined by the plurality of intersecting ribs 476. In this example, the recesses 484 are two large rectangles arranged perpendicular to the side edges and two large rectangles arranged perpendicular to the end edges. The recesses 484 constitute gaps between the plurality of intersecting ribs 476 that are two to three times wider than the other gaps between the plurality of intersecting ribs 476 and four to six times longer than the other gaps between the plurality of intersecting ribs 476. The upper base portion 472 is integrally molded as a single piece of plastic.

Figure 53:
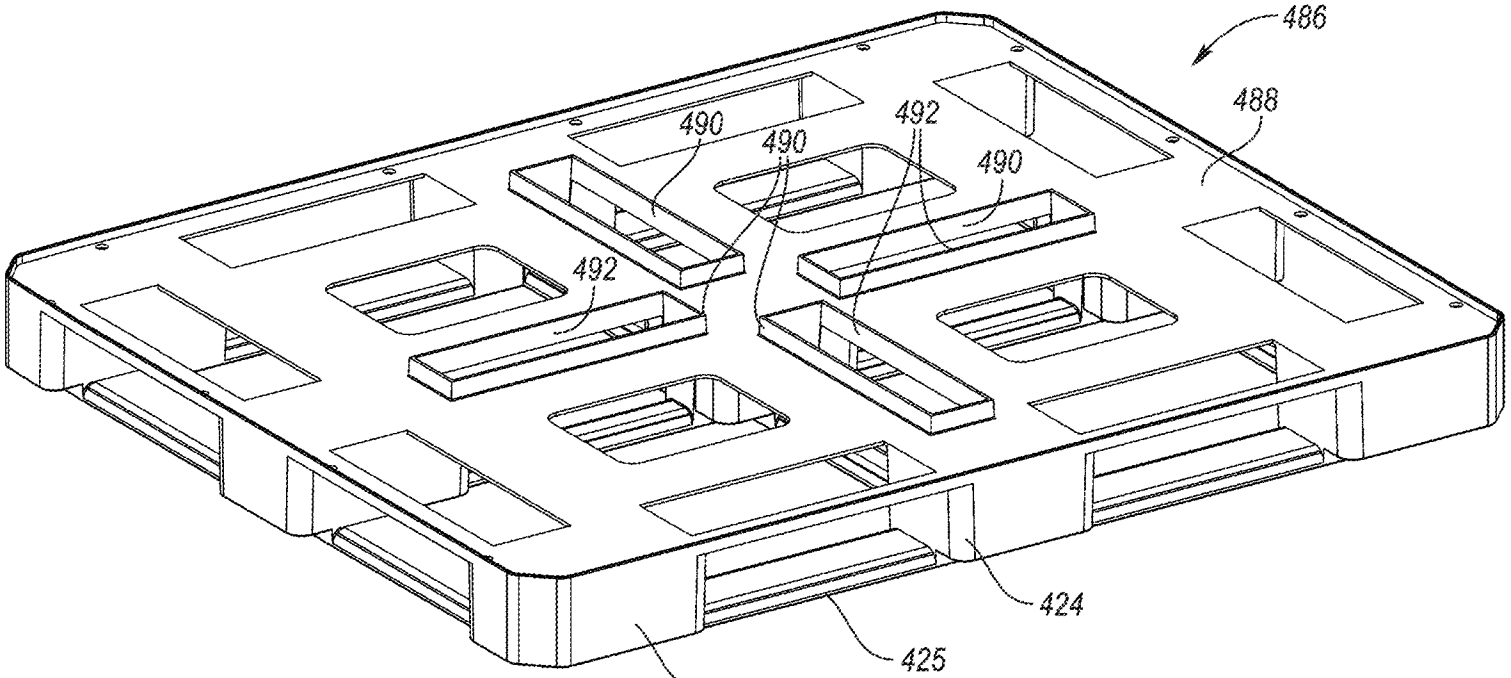
FIG. 53 is an upper perspective view of the lower base portion of the pallet bin of FIG. 32.

FIG. 53 is an upper perspective view of the lower base portion 486. The lower base portion 486 is integrally molded as a single piece of plastic. The lower base portion 486 includes a substantially planar upper planar portion 488 having a plurality of upward projections 490 therefrom defining openings 492 therein that extend through the substantially planar upper planar portion 488. In this example, the plurality of upward projections 490 are large rectangles each formed by a rib projected upward from the periphery of the opening 492. The plurality of upward projections 490 are complementary to the recesses 484 on the bottom surface of the upper base portion 472. The columns 424 extend downward from the substantially planar upper planar portion 488. Optional runners 425 may extend between lower ends of the plurality of columns 424.

Figure 54:
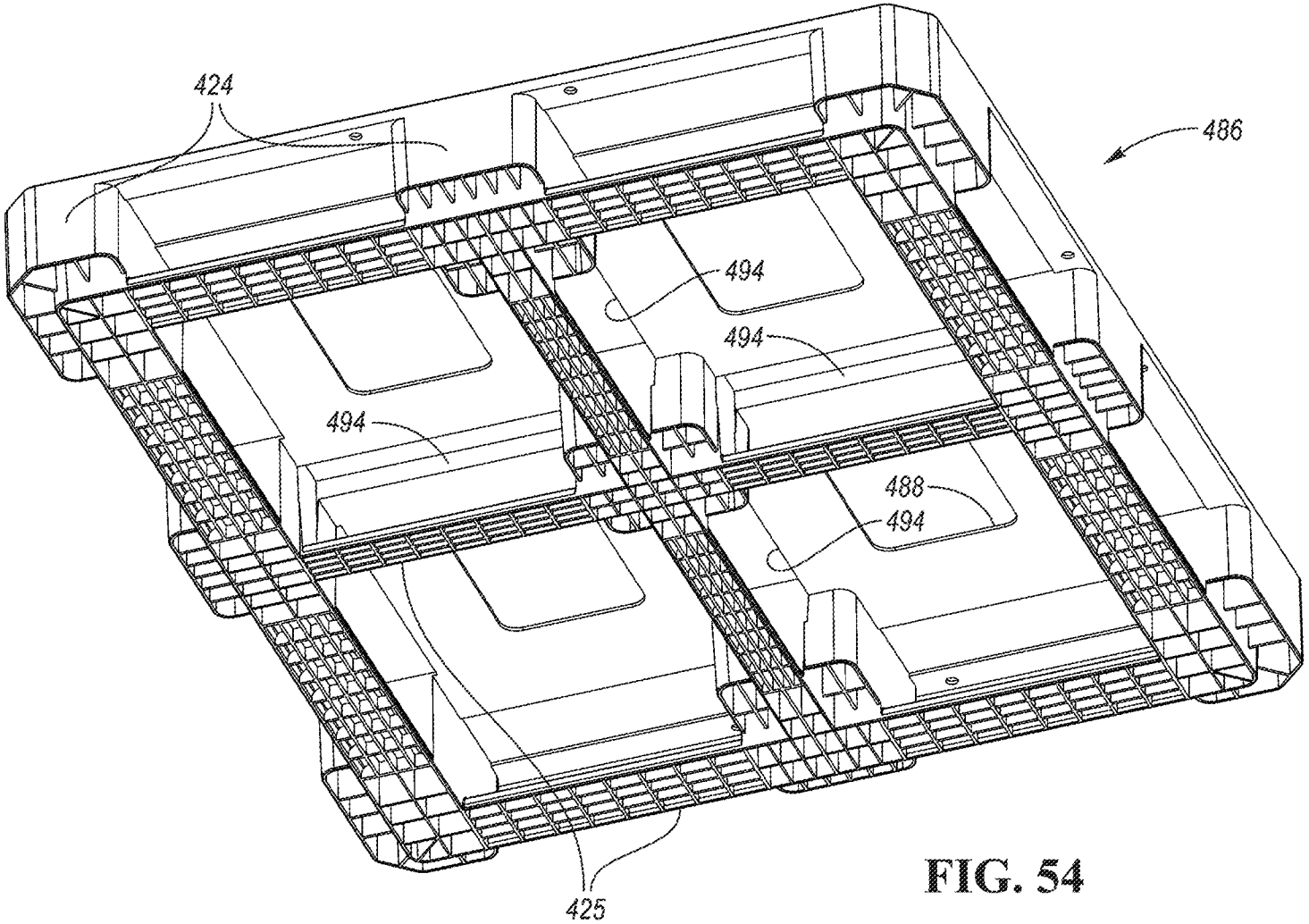
FIG. 54 is a bottom perspective view of the lower base portion of FIG. 53.

FIG. 54 is a bottom perspective view of the lower base portion 486. As shown, the plurality of columns 424 are formed to include a plurality of ribs extending downward from the substantially planar upper planar portion 488. Other than at the plurality of columns 424, there need not be any ribs extending downward from the substantially planar upper planar portion 488. The optional runners 425 may also include ribs extending downward.

Figures 55, 56:
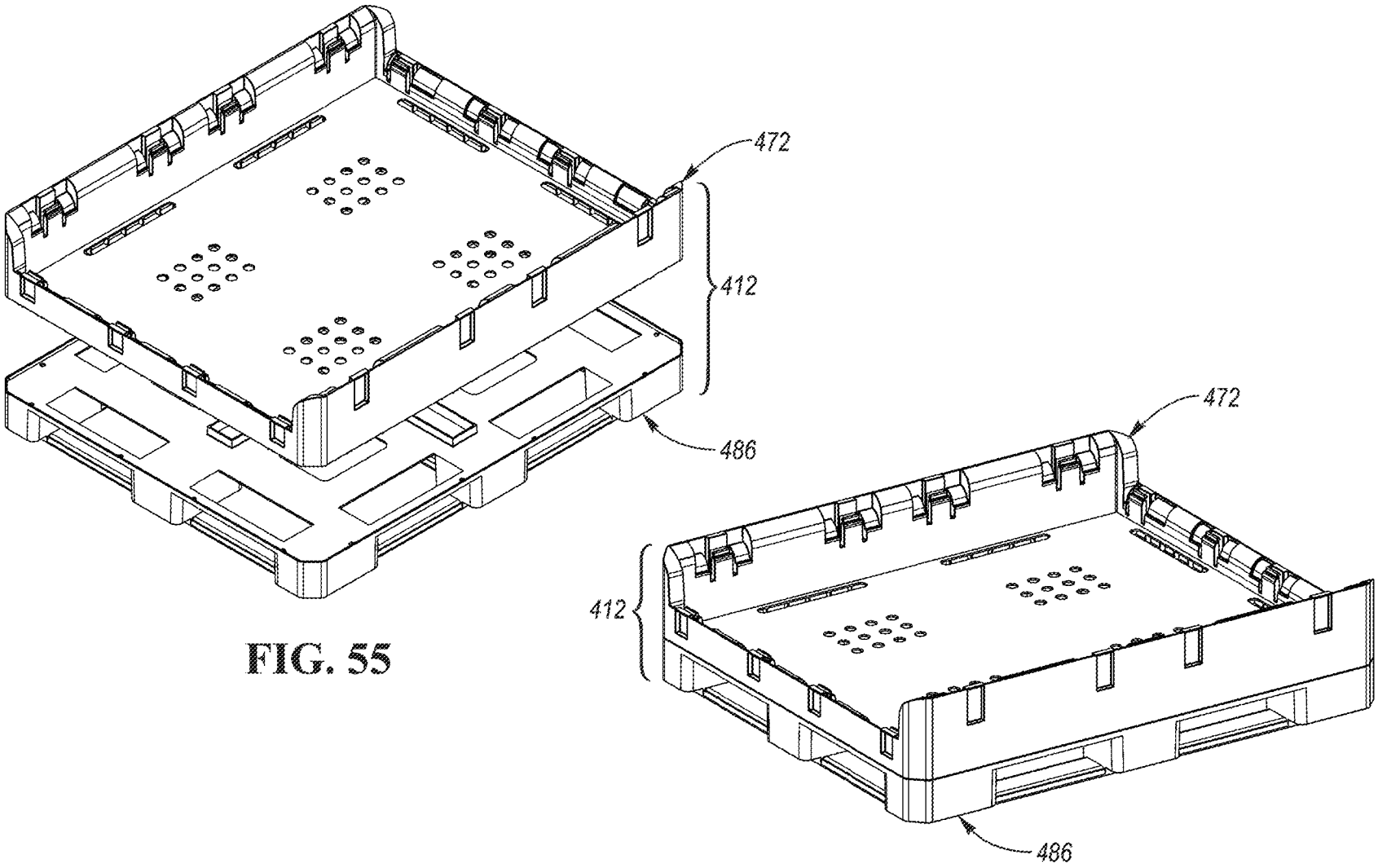
FIG. 55 shows a first step in assembling the upper base portion of FIG. 51 to the lower base portion of FIG. 53.
FIG. 56 shows the assembled base with the upper base portion on the lower base portion.

FIG. 55 shows a first step in assembling the upper base portion 472 to the lower base portion 486 to form the base 412. FIG. 56 shows the assembled base 412 with the upper base portion 472 on the lower base portion 486. The plurality of upward projections 490 (FIG. 53) interlock with the recesses 484 (FIG. 52). The recesses 484 and the plurality of upward projections 490 are complementary to one another and together form interlocking portions. Of course, the projecting interlocking portions and recessed interlocking portions could be switched between the upper base portion 472 and the lower base portion 486 or some could be on each.

The plurality of intersecting ribs 476 may be hot plate welded, secured with fasteners, secured with adhesive, or some combination of these methods, to the substantially planar upper planar portion 488. The substantially planar upper planar portion 488 covers the plurality of intersecting ribs 476, eliminating an area where food, dirt and bacteria could be trapped (in food-related applications).

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers on method claim steps are for ease of reference in dependent claims only and do not signify a required sequence of steps unless other explicitly recited in the claims.

What is claimed is:

1. A container comprising:

a base; and a plurality of walls extending upward from the base, the plurality of walls including a first wall, the first wall including a plurality of horizontal corrugations, the plurality of horizontal corrugations include a plurality of vertically-spaced horizontal inward corrugations forming horizontal elongated recesses on an exterior surface of the first wall, a plurality of vertical ribs extending across each of the horizontal elongated recesses.

2. The container of claim 1 wherein the plurality of walls are pivotably connected to the base and movable between an upright position and a collapsed position on the base.

3. The container of claim 2 wherein the base includes a plurality of column defining tine openings therebetween.

4. The container of claim 1 wherein the first wall does not include any horizontal ribs.

5. The container of claim 1 wherein the first wall includes an outer panel, the plurality of vertical ribs projected from the outer panel, the outer panel curving to form the plurality of horizontal corrugations.

6. The container of claim 1 wherein the plurality of vertical ribs extend across a plurality of horizontal elongated recesses formed by the plurality of horizontal corrugations.

7. The container of claim 1 wherein the first wall includes a pair of outer vertical inward corrugations connected by the plurality of horizontal corrugations.

8. A container comprising:

a base; and a plurality of walls extending upward from the base, the plurality of walls including a first wall, the first wall including a plurality of horizontal corrugations intersected by a plurality of vertical ribs, wherein the plurality of vertical ribs includes a plurality of interior vertical ribs and a plurality of exterior vertical ribs.

9. The container of claim 8 wherein the plurality of walls are pivotably connected to the base and movable between an upright position and a collapsed position on the base.

10. The container of claim 9 wherein the base includes a plurality of column defining tine openings therebetween.

11. The container of claim 10 wherein the first wall does not include any horizontal ribs.

12. The container of claim 11 wherein the first wall includes an outer panel, the plurality of vertical ribs projected from the outer panel, the outer panel curving to form the plurality of horizontal corrugations.

13. The container of claim 12 wherein the plurality of vertical ribs extend across a plurality of horizontal elongated recesses formed by the plurality of horizontal corrugations.

14. A container comprising:

an upper base portion including an upper support surface, a plurality of ribs projecting downward from the upper support surface, a pair of side upstanding portions projecting upward from side edges of the upper support surface, a pair of end upstanding portions projecting upward from end edges of the upper support surface;

a lower base portion including a plurality of columns extending downward from an upper planar portion;

a plurality of interlocking portions securing the upper base portion to the lower base portion; and a plurality of walls including a pair of side walls pivotably connected to the pair of side upstanding portions and a pair of end walls pivotably connected to the pair of end upstanding portions.

15. The container of claim 14 wherein the plurality of interlocking portions include a plurality of recesses and a plurality of projections, wherein the plurality of projections are received in the plurality of recesses.

16. A container comprising:

a base; and a plurality of walls extending upward from the base, the plurality of walls including a first wall, the first wall including a plurality of horizontal corrugations intersected by a plurality of vertical ribs, wherein the first wall includes an outer panel, the plurality of horizontal corrugations formed by the outer panel curve inward and then outward, and the plurality of vertical ribs project inward from the outer panel and intersecting the plurality of horizontal corrugations.

17. The container of claim 16 wherein an interior surface of the first wall does not include any horizontal ribs.

18. The container of claim 17 wherein transitions from the outer panel to the plurality of horizontal corrugations are curved.

19. The container of claim 18 wherein the plurality of horizontal corrugations form a plurality of horizontal elongated recesses on an exterior surface of the first wall.

20. The container of claim 19 further including a plurality of exterior vertical ribs intersecting the plurality of horizontal elongated recesses.

21. The container of claim 20 wherein the plurality of exterior vertical ribs are offset laterally from the plurality of vertical ribs.

22. The container of claim 21 wherein the plurality of walls are pivotably connected to the base.

23. A container comprising:

a base;

a plurality of walls extending upward from the base, the plurality of walls including a first wall having an access opening;

a door movable between a closed position over the access opening and an open position permitting access through the access opening; and a hinge member hingeably connecting the door to the first wall, the hinge member including a plurality of lower knuckle portions hingeably connected to the first wall and a plurality of upper knuckle portions hingeably connected to the door.

24. The container of claim 23 wherein the plurality of lower knuckle portions are arranged in two spaced-apart lower rows defining a lower hinge pin-receiving channel therebetween.

25. The container of claim 24 wherein the hinge member includes a plurality of perpendicular ribs reinforcing the plurality of lower knuckle portions and the plurality of upper knuckle portions.

26. The container of claim 25 wherein the access opening opens through an uppermost edge of the first wall.

27. The container of claim 24 wherein the plurality of upper knuckle portions are arranged in two spaced-apart upper rows defining an upper hinge pin-receiving channel therebetween.

28. The container of claim 27 wherein the first wall includes a lower hinge pin received in the lower hinge pin-receiving channel and the door includes an upper hinge pin received in the upper hinge pin-receiving channel.

29. The container of claim 28 wherein the lower knuckle portions snap-fit over the lower hinge pin and the upper knuckle portions snap-fit over the upper hinge pin.

30. The container of claim 23 wherein the hinge member, including the upper knuckle portions and the lower knuckle portions, is formed as a single piece.

31. A container comprising:

an upper base portion including an upper support surface, a plurality of ribs projecting downward from the upper support surface to define a plurality of recesses therebetween, a pair of side upstanding portions projecting upward from side edges of the upper support surface, a pair of end upstanding portions projecting upward from end edges of the upper support surface;

a lower base portion including a plurality of columns extending downward from an upper planar portion, a plurality of projections projecting upward from the upper planar portion and received in the plurality of recesses; and a plurality of walls including a pair of side walls pivotably connected to the pair of side upstanding portions and a pair of end walls pivotably connected to the pair of end upstanding portions.

32. The container of claim 31 wherein the upper planar portion covers the plurality of ribs.

33. The container of claim 32 wherein the plurality of ribs are secured to the upper planar portion.

34. The container of claim 33 wherein the plurality of ribs are hot plate welded to the upper planar portion.

35. The container of claim 31 wherein the plurality of recesses include at least two large rectangles arranged perpendicular to the side edges and at least two large rectangles arranged perpendicular to the end edges.

36. The container of claim 35 further including runners connecting lower ends of some of the plurality of columns.

* * * * *